US009526271B2

(12) United States Patent
Tanaka et al.

(10) Patent No.: US 9,526,271 B2
(45) Date of Patent: Dec. 27, 2016

(54) METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

(71) Applicant: JAPAN TOBACCO INC., Tokyo (JP)

(72) Inventors: Yasuo Tanaka, Tokyo (JP); Tatsuya Kusakabe, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 713 days.

(21) Appl. No.: 13/963,653

(22) Filed: Aug. 9, 2013

(65) Prior Publication Data

US 2013/0327346 A1 Dec. 12, 2013

Related U.S. Application Data

(63) Continuation of application No. PCT/JP2012/054827, filed on Feb. 27, 2012.

(30) Foreign Application Priority Data

Mar. 2, 2011 (JP) ..... 2011-045290

(51) Int. Cl.
*A24B 15/34* (2006.01)
*B05D 3/04* (2006.01)
(Continued)

(52) U.S. Cl.
CPC ..... *A24B 15/34* (2013.01); *A24B 3/12* (2013.01); *A24B 3/14* (2013.01); *A24B 15/10* (2013.01);
(Continued)

(58) Field of Classification Search
None
See application file for complete search history.

(56) References Cited

U.S. PATENT DOCUMENTS 4,596,259 A 6/1986 White et al.
5,186,185 A 2/1993 Mashiko et al.
(Continued)

FOREIGN PATENT DOCUMENTS

BR 9609628 A 4/1999
CN 1708241 A 12/2005
(Continued)

OTHER PUBLICATIONS

Korean Office Action for Korean Application No. 10-2013-7023164, dated Oct. 28, 2014, with a partial English translation.
(Continued)

*Primary Examiner* — Erma Cameron
(74) *Attorney, Agent, or Firm* — Birch, Stewart, Kolasch & Birch, LLP

(57) ABSTRACT

A method for preparing a flavor-containing sheet for a smoking article, characterized by includes a step of extending a raw material slurry on a substrate, wherein the slurry contains polysaccharide including at least one of carrageenan and gellan gum, a flavor, an emulsifier and 70 to 95 wt % of water, has the flavor content of 100 to 1000 wt % based on the polysaccharide, and has a temperature of 60 to 90° C. in a sol state, a step of cooling the extended raw material slurry to a sample temperature of 0 to 40° C. to form a gel, and a heat-drying step includes heating the gelled raw material and drying it at a sample temperature of 70 to 100° C.

9 Claims, 28 Drawing Sheets

(51) Int. Cl.

| | |
|---|---|
| ***A24B 3/12*** | (2006.01) |
| ***A24B 15/30*** | (2006.01) |
| ***B05D 3/02*** | (2006.01) |
| ***A24B 3/14*** | (2006.01) |
| ***A24B 15/28*** | (2006.01) |
| ***A24B 15/10*** | (2006.01) |
| ***A24D 1/00*** | (2006.01) |
| ***A24B 15/14*** | (2006.01) |

(52) U.S. Cl.

CPC ..... *A24B 15/14* (2013.01); *A24B 15/282* (2013.01); *A24B 15/301* (2013.01); *A24B 15/302* (2013.01); *A24B 15/303* (2013.01); *A24D 1/002* (2013.01); *B05D 3/02* (2013.01); *B05D 3/0254* (2013.01); *B05D 3/0426* (2013.01)

(56) References Cited

U.S. PATENT DOCUMENTS

| | | | | |
|---|---|---|---|---|
| 6,109,272 | A | 8/2000 | Saito et al. | |
| 2004/0129280 | A1 | 7/2004 | Woodson et al. | |
| 2005/0039767 | A1 | 2/2005 | Mua et al. | |
| 2005/0244521 | A1 | 11/2005 | Strickland et al. | |
| 2007/0246054 | A1 | 10/2007 | Gedevanishvili et al. | |
| 2008/0011311 | A1 | 1/2008 | Ojima et al. | |
| 2011/0036367 | A1 | 2/2011 | Saito et al. | |
| 2011/0061667 | A1 | 3/2011 | Tanaka et al. | |
| 2011/0139164 | A1* | 6/2011 | Mua | A24B 3/14 131/111 |
| 2011/0220130 | A1* | 9/2011 | Mua | A24B 13/00 131/111 |
| 2013/0019884 | A1 | 1/2013 | Sashide et al. | |
| 2013/0319430 | A1 | 12/2013 | Tanaka | |
| 2013/0327347 | A1 | 12/2013 | Tanaka et al. | |

FOREIGN PATENT DOCUMENTS

| | | | |
|---|---|---|---|
| CN | 101374429 | A | 2/2009 |
| EP | 0 135 266 | A | 11/1988 |
| EP | 2279677 | A1 | 2/2011 |
| EP | 2 289 357 | A1 | 3/2011 |
| JP | 64-27461 | A | 1/1989 |
| JP | 4-75578 | A | 3/1992 |
| JP | 9-28366 | A | 2/1997 |
| JP | 11-113552 | A | 4/1999 |
| JP | 11-509566 | A | 8/1999 |
| JP | 2001-231468 | A | 8/2001 |
| JP | 2007-23065 | A | 2/2007 |
| JP | 4109804 | B2 | 7/2008 |
| JP | 5514952 | B2 | 6/2014 |
| JP | 5514953 | B2 | 6/2014 |
| KR | 10-0904333 | B1 | 6/2009 |
| TW | 201016148 | A1 | 5/2010 |
| TW | 201240613 | A1 | 10/2012 |
| TW | 201240614 | A1 | 10/2012 |
| WO | WO 97/02759 | A1 | 1/1997 |
| WO | WO 2006/023281 | A2 | 3/2006 |
| WO | WO 2009/142159 | A1 | 11/2009 |
| WO | WO 2009/157240 | A1 | 12/2009 |

OTHER PUBLICATIONS

Korean Office Action for Korean Application No. 10-2013-7023165, dated Oct. 31, 2014, with an English translation.
Korean Office Action for Korean Application No. 10-2013-7023185, dated Oct. 31, 2014, with an English translation.
Taiwanese Office Action for Taiwanese Application No. 101106668, dated Oct. 28, 2014, with an English translation.
Chinese Office Action dated Jan. 11, 2016, for Chinese Application No. 201280019134.7 with the English translation.
Office Action issued in the copending U.S. Appl. No. 13/963,821, mailed on Feb. 19, 2016.
Chinese Office Action for Chinese Application No. 201280019148.9, dated Feb. 16, 2016, with an English tranlsation.
Chinese Office Action, dated Mar. 4, 2016, for Chinese Application No. 201280019136.6 , along with an English translation.
European Office Action, dated Jun. 16, 2016, for European Application No. 12 751 885.0.
European Office Action, dated Jun. 16, 2016, for European Application No. 12 752 507.9.
European Office Action, dated Jun. 16, 2016, for European Application No. 12 752 746.3.
International Search Report Issued in PCT/JP2012/054827, mailed on Jun. 5, 2012.
PCT/ISA/237—Mailed on Jun. 5, 2012, issued in PCT/JP2012/054827.
China Office Action for No. 201280019134.7 dated Jun. 1, 2015.
China Office Action for No. 201280019148.9 dated Jun. 11, 2015.
Chinese Office Action and Search Report, dated Jul. 3, 2015, for Chinese Application No. 201280019136.6, with an English translation thereof.
AGARGEL XP-002727227, pp. 1-2, from Internet on Jul. 28, 2014.
CPKelco, GENU Carrageenan Book XP-002727226.
Kochumalayil et al., Tamarind seed xyloglucan—a thermostable high-performance biopolymer from non-food feedstock XP 002727189 Journal of Materials Chemistry, vol. 20, Apr. 27, 2010, pp. 4321-4327.
Miyoshi et al. "Rheological and thermal studies of gel-sol transition in gellan gum aqueous solutions" XP-002727190 Carbohydrate Polymers, vol. 30, 1996, pp. 109-119.
Nishinari et al., XP-002727188 "Rheological and related study of gelation of xyloglucan in the presence of small molecules and other polysaccharides" Cellulose August, vol. 13, No. 4, Aug. 2006, pp. 365-374.
Nitta et al., "Synergistic Gel Formation of Xyloglucan/Gellan Mixtures as Studied by Rheology, DSC, and Circular Dicroism" XP-002727187 Biomacromolecules, vol. 4., No. 6, Nov. 2003, pp. 1654-1660.
Nitta et al., XP055097026 "Gelation and gel properties of polysaccharides gellan gum and tamarind xyloglucan", Journal of biological macromolecules, Nov. 1, 2005, pp. 47-52.
PCT/JP2012/045827 International Preliminary Report on Patentability dated Sep. 3, 2013.
PCT/JP2012/054826 International Preliminary Report on Patentability dated Sep. 3, 2013.
PCT/JP2012/054828 International Preliminary Report on Patentability dated Sep. 3, 2013.
Taiwanese Office Action for Taiwanese Application No. 101106671, dated Oct. 28, 2014, with an English translation.
Malaysia Office Action dated Nov. 30, 2015 for Application No. PI2013701423.
Malaysia Office Action dated Nov. 30, 2015 for Application No. PI2013701424.
Chinese Office Action for corresponding Application No. 201280019134.7 mailed Jul. 19, 2016.
Non-Final Office Action in co-pending U.S. Appl. No. 13/963,499 issued on Aug. 11, 2016.
China Light Industry Press, "Food Thickener" 2nd edition, Jan. 2009.
Chinese Office Action cited in corresponding application dated Sep. 1, 2016 together with English-language translation.
Chinese Office Action cited in corresponding application dated Sep. 5, 2016 together with English language translation.

* cited by examiner

METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

CROSS REFERENCE TO RELATED APPLICATIONS

This application is a Continuation application of PCT Application No. PCT/JP2012/054827, filed Feb. 27, 2012 and based upon and claiming the benefit of priority from prior Japanese Patent Application No. 2011-045290, filed Mar. 2, 2011, the entire contents of all of which are incorporated herein by reference.

BACKGROUND OF THE INVENTION

1. Field of the Invention

The present invention relates to a method for preparing a flavor-containing sheet used for a smoking article, a flavor-containing sheet for a smoking article prepared by the method, and a smoking article comprising the same.

2. Description of the Related Art

If a volatile flavor component such as menthol is added to cut tobacco in a solution state, the flavor component is dissipated in a long-term storage and the flavor effect does not last. In order to solve such a problem, various reports have been made.

Patent Documents 1 and 2 disclose that a flavor component is placed in the filter part of a cigarette with the flavor component coated with a natural polysaccharide to suppress the volatilization and dissipation of the flavor component; and the coated favor component is crushed by pressing it to release the flavor at the time of smoking. Patent Document 3 discloses that a flavor component is placed in the filter part of a cigarette with the flavor component coated with a water-soluble matrix such as dextrin to suppress the volatilization and dissipation of the flavor component; and the water-soluble matrix is dissolved by the moisture in the mainstream smoke to release the flavor at the time of smoking. Thus, when the flavor component is placed in the filter part which is a non-burning part of the cigarette, there is a time lag until the flavor is tasted because the flavor is released by pressing the filter part at the time of smoking or dissolving the water-soluble matrix by the moisture in the mainstream smoke.

On the other hand, Patent Documents 4 to 6 report an example in which a flavor component is placed in a burning part, that is, cut tobacco or a cigarette paper which wraps it.

Patent Document 4 discloses that a cigarette paper which wraps tobacco filler is coated with a flavor material in which the flavor component is incorporated into the three-dimensional network of the glucan molecules. The cigarette of Patent Document 4 has a good flavor-retaining property since the flavor component is fixed and retained with incorporated into the three-dimensional network of the glucan molecules. However, the flavor component is present in the glucan molecules in a relatively small amount (20 wt % or less). Accordingly, in the case of the flavor component which requires a relatively large amount to be added, such as menthol, the blending amount of the flavor material to the cigarette becomes high.

Patent Document 5 discloses that "a stabilized flavor substance which is stable up to 180° C." is prepared by mixing a liquid flavor with a carrageenan sol; dropping the mixture into an ionic solution (a solution containing potassium ions) to prepare a particulate gel; and drying the gel in the air. However, the method of Patent Document 5 requires long periods of time and large facilities in order to prepare a large amount of the material because the granular gel is dried in the air. In addition, the method requires the addition of a metal ion (gelling accelerator) in order to form a gel.

Patent Document 6 reports that a sheet containing a flavor component with coated with a gel of polysaccharide is produced by drying a slurry containing the flavor component such as menthol and the polysaccharide; and the sheet is cut and the cut pieces is added to cut tobacco. According to the report, it takes a week to dry the slurry at 40° C.

As described above, various reports have been made as technique for suppressing the volatilization of the flavor component, but there is still a need for a easy method of preparing a flavor material having a further improved flavor-retaining property after storage.

PRIOR ART DOCUMENT

Patent Document

Patent Document 1: Jpn. Pat. Appln. KOKAI Publication No. 64-27461

Patent Document 2: Jpn. Pat. Appln. KOKAI Publication No. 4-75578

Patent Document 3: International Publication No. 2009-157240

Patent Document 4: Jpn. Pat. Appln. KOKAI Publication No. 9-28366

Patent Document 5: Jpn. PCT National Publication No. 11-509566

Patent Document 6: International Publication No. 2009-142159

BRIEF SUMMARY OF THE INVENTION

Problem to be Solved by the Invention

An object of the present invention is to provide a method for preparing a flavor-containing sheet for a smoking article in a shorter time wherein the sheet has a high flavor content, a high flavor yield, and a high post-storage flavor-retaining property when incorporated into the smoking article. Further, an object of the present invention is to provide a flavor-containing sheet for a smoking article which has a high post-storage flavor-retaining property when incorporated into the smoking article and can be prepared in a shorter time.

Means for Solving the Problem

The present inventors have examined in order to solve the problems. As a result, they have found that even if a high drying temperature is employed, it is possible to prepare a flavor-containing sheet which has a high flavor content and a high flavor yield and maintains the high flavor content even after storage, by using carrageenan or gellan gum as a polysaccharide and cooling the sheet once before heat-drying and then drying it, in the preparation of a flavor-containing sheet by heat-drying a raw material slurry containing a polysaccharide, a flavor and an emulsifier. Thus, they have completed the present invention.

That is, according to an aspect of the present invention, there is provided a method for preparing a flavor-containing sheet for a smoking article, characterized by comprising: a step of extending a raw material slurry on a substrate, wherein the slurry contains polysaccharide including at least one of carrageenan and gellan gum, a flavor, an emulsifier and 70 to 95 wt % of water, has the flavor content of 100 to 1000 wt % based on the polysaccharide, and has a temperature of 60 to 90° C. in a sol state; a step of cooling the extended raw material slurry to a sample temperature of 0 to 40° C. to form a gel; and a heat-drying step comprising heating the gelled raw material and drying it at a sample temperature of 70 to 100° C.

According to a preferred embodiment, the emulsifier is 0.5 to 5 wt % of lecithin based on the polysaccharide. Alternatively, according to a preferred embodiment, the emulsifier is an ester selected from the group consisting of glycerin fatty acid ester, polyglycerin fatty acid ester, sorbitan fatty acid ester, propylene glycol fatty acid ester and sucrose fatty acid ester.

According to a preferred embodiment, the polysaccharide is contained in the raw material slurry at a concentration of 2 to 5 wt %.

According to a preferred embodiment, the flavor is menthol. According to a more preferred embodiment, the menthol content is in a range of 250 to 500 wt % based on the polysaccharide.

According to another aspect of the present invention, there is provided a flavor-containing sheet for a smoking article, characterized in that it is prepared by the above-mentioned method.

According to another aspect of the present invention, there is provided a smoking article comprising cut tobacco, characterized in that cut pieces of the above-mentioned flavor-containing sheet for a smoking article are blended with the cut tobacco.

Effects of the Invention

According to the method for preparing a flavor-containing sheet for a smoking article of the present invention, it is possible to prepare a flavor-containing sheet for a smoking article in a shorter time wherein the sheet has a high flavor content, a high flavor yield, and a high post-storage flavor-retaining property when incorporated into the smoking article. Further, the flavor-containing sheet for a smoking article of the present invention has a high post-storage flavor-retaining property when incorporated into the cigarette and can be prepared in a shorter time.

DETAILED DESCRIPTION OF THE INVENTION

Figure 1:
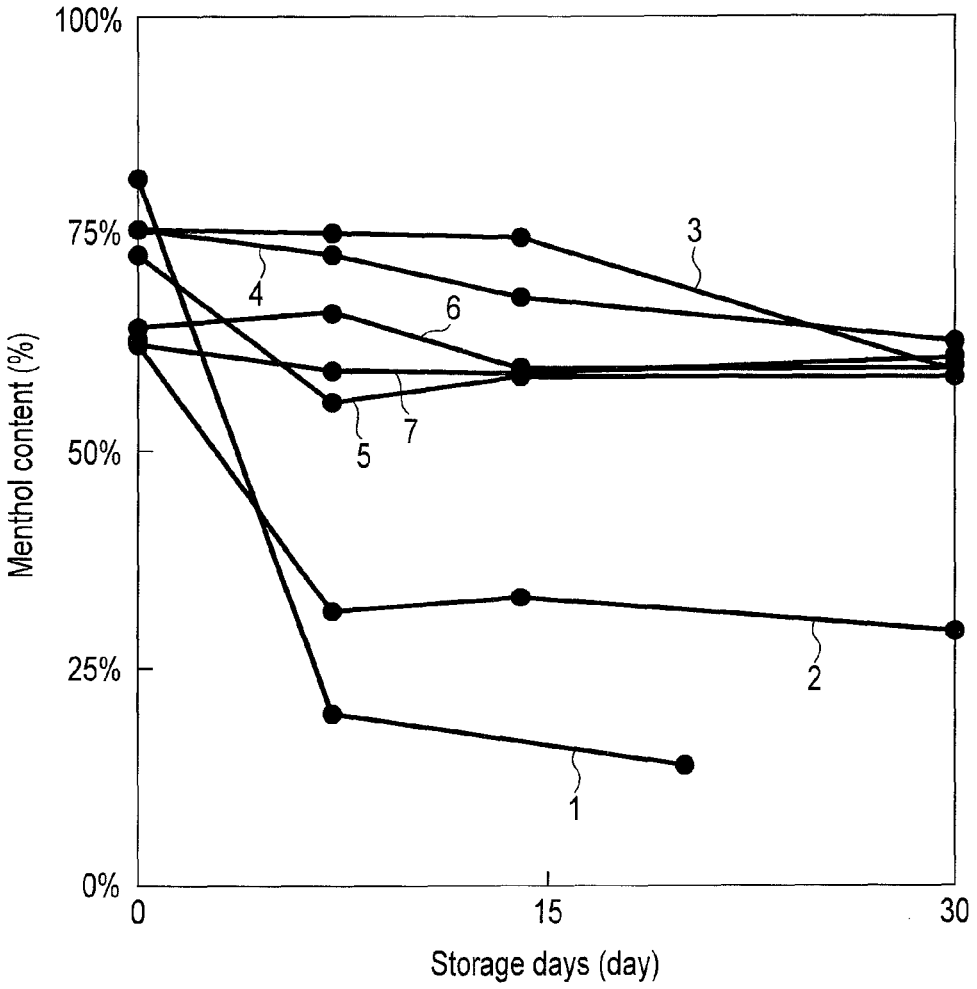
FIG. 1 is a graph showing the menthol content of menthol-containing sheets after storage periods.

The present invention will be explained below. The following explanations are intended to describe the present invention in detail, and are not intended to limit the present invention.

A flavor contained in the flavor-containing sheet of the present invention is not limited as long as it is used for a smoking article. Any type of flavor can be used. Main examples of the flavor include menthol, leaf tobacco extract; natural plant flavors (e.g., cinnamon, sage, herb, chamomile, kudzu (*Pueraria lobata*), *hydrangeae dulcis folium*, clove, lavender, cardamom, caryophyllus, nutmeg, bergamot, geranium, honey essence, rose oil, lemon, orange, cassia bark, caraway, jasmine, ginger, coriander, vanilla extract, spearmint, peppermint, cassia, coffee, celery, cascarilla, sandalwood, cocoa, ylang ylang, fennel, anise, licorice, St John's bread, prune extract, and peach extract); saccharides (e.g., glucose, fructose, isomerized saccharide, and caramel); cocoa (e.g., powder and extract); esters (e.g., isoamyl acetate, linalyl acetate, isoamyl propionate, and linalyl butyrate); ketones (e.g., menthone, ionone, damascenone, and ethyl maltol); alcohols (e.g., geraniol, linalool, anethole, and eugenol); aldehydes (e.g., vanillin, benzaldehyde, and anisaldehyde); lactones (e.g., γ-undecalactone and γ-nonalactone); animal flavors (e.g., musk, ambergris, civet, and castoreum); and hydrocarbons (e.g., limonene and pinene). A flavor which easily forms a dispersion state in a solvent by addition of an emulsifier, such as a hydrophobic flavor and oil-soluble flavor may be preferably used. Such a flavor may be used alone or in combination.

Hereinafter, the present invention will be explained with an example where menthol is used as a flavor.

1. Menthol-Containing Sheet for Smoking Article

In an embodiment of the present invention, a menthol-containing sheet for a smoking article (hereinafter referred to as "menthol-containing sheet") is prepared by the method comprising:

a step of extending a raw material slurry on a substrate, wherein the slurry contains polysaccharide including at least one of carrageenan and gellan gum, menthol, an emulsifier and 70 to 95 wt % of water, has the flavor content of 100 to 1000 wt % based on the polysaccharide, and has a temperature of 60 to 90° C. in a sol state;

a step of cooling the extended raw material slurry to a sample temperature of 0 to 40° C. to form a gel; and a heat-drying step comprising heating the gelled raw material and drying it at a sample temperature of 70 to 100° C.

The term "sample temperature" used herein means a temperature on the surface of a sample (i.e., a slurry or a sheet).

(1) Preparation of Raw Material Slurry

In the present invention, the raw material slurry can be prepared by a method comprising: (i) a step of mixing polysaccharide containing at least one of carrageenan and gellan gum with water and heating the mixture to prepare an aqueous solution of the polysaccharide; and (ii) a step of adding menthol and an emulsifier to the aqueous solution and kneading and emulsifying the mixture.

Specifically, the step (i) can be performed by adding polysaccharide to water in small amounts to dissolve it in water while stirring. The heating temperature in the step may be from 60 to 90° C., preferably from 75 to 85° C. The step (ii) can be performed by any known emulsification techniques using a homogenizer since the raw material slurry has a viscosity of about 10,000 mPas (sol state), which does not interfere with the emulsification, at the above heating temperature.

Polysaccharide is preferably contained in the raw material slurry at a concentration of 2 to 5 wt %. For example, when 10 L of water is used as a solvent for the raw material slurry, the raw material slurry may contain 200 to 500 g of polysaccharide. More preferably, polysaccharide is contained in the raw material slurry at a concentration of 3 to 5 wt % (see Example 10 below).

The composition of the raw material slurry can be as follows: for example, 500 g of polysaccharide, 500 to 5000 g of menthol, and 50 to 500 mL of a solution containing 5 wt % of an emulsifier, per 10 L of water.

The moisture content of the raw material slurry is from 70 to 95 wt %, preferably from 80 to 90 wt %.

The ratio (weight ratio) of polysaccharide and menthol in the raw material slurry may be in a range of 1:1 to 1:10, preferably 1:2.5 to 1:5. That is, the blending amount of menthol may be in a range of 100 to 1000 wt % based on the polysaccharide, preferably 250 to 500 wt % based on the polysaccharide (see Example 11 below).

The raw material slurry may contain either carrageenan or gellan gum as the polysaccharide, or may contain both of them. Further, the polysaccharide may be consisted of only carrageenan and/or gellan gum, or other polysaccharide such as tamarind gum may be contained in addition to carrageenan and/or gellan gum. In this regard, other polysaccharide is contained in the slurry in a blending amount lower than the blending amount of carrageenan and gellan gum. As the carrageenan, κ-carrageenan may be used.

In the present invention, the polysaccharide has a property of fixing micelle of menthol to coat it, by forming gel when cooling once after heating. Regarding carrageenan and gellan gum, it is found that each aqueous solution of these exhibits especially excellent sol-gel transition characteristics in response to temperature (see Examples 4 and 9 below). That is, once the aqueous carrageenan solution and the aqueous gellan gum solution are cooled and form gel, these solution have characteristics of being capable of maintaining the gel state without easily returning to a sol state even if the temperature is raised afterward (see FIGS. 2B and 7B). Even if menthol coated with carrageenan or gellan gum is once cooled and then exposed to high temperature in the heat-drying step, the coat of carrageenan or gellan gum is hard to return to the sol state due to the characteristics, and the menthol in the coat can be stably maintained (see FIGS. 7D and 7F). The characteristics are referred to as "temperature-responsive sol-gel transition characteristics" in the present invention.

Thus, the polysaccharide having temperature-responsive sol-gel transition characteristics has advantages in that high post-storage flavor retaining properties can be achieved by coating menthol with it, and also in that it is not necessary to add metal ions (a gelation accelerator), if the temperature-responsive sol-gel transition characteristics are used for gelation.

In the present invention, 1-menthol may be used as menthol.

In the present invention, a naturally occurring emulsifier such as lecithin, specifically, SUN LECITHIN A-1 (Taiyo Kagaku Co., Ltd.), may be used as the emulsifier.

When lecithin is used as the emulsifier, lecithin may be contained in the slurry in an amount of 0.5 to 5 wt % based on the polysaccharide. When carrageenan is used as the polysaccharide, the addition amount of lecithin is preferably from 0.5 to 2 wt % based on the polysaccharide. When gellan gum is used as the polysaccharide, the addition amount of lecithin is preferably from 0.5 to 5 wt % based on the polysaccharide, more preferably from 0.5 to 2 wt % based on the polysaccharide (see Example 12 below).

As the emulsifier, esters selected from the group consisting of glycerin fatty acid ester, polyglycerin fatty acid ester, sorbitan fatty acid ester, propylene glycol fatty acid ester, and sucrose fatty acid ester may be used in addition to lecithin.

Glycerin fatty acid ester includes, for example, fatty acid monoglycerides such as monoglyceride monostearate or monoglyceride succinate; polyglycerin fatty acid ester includes, for example, pentaglycerin monostearate; sorbitan fatty acid ester includes, for example, sorbitan monostearate; propylene glycol fatty acid ester includes, for example, propylene glycol monostearate; and sucrose fatty acid ester includes, for example, sucrose stearic acid ester (see Example 13 below). These emulsifiers may be also contained in the slurry in an amount of 0.5 to 5 wt % based on the polysaccharide.

(2) Extension of Raw Material Slurry on Substrate

The prepared raw material slurry having a temperature of 60 to 90° C. is extended on a substrate.

The raw material slurry can be extended by extruding the raw material slurry on the substrate with a casting gate or through a slit die. As the substrate, any type of substrate may be used, as long as the menthol-containing sheet prepared by dry-forming can be peeled off from the substrate. For example, a polyethylene terephthalate (PET) film (FE2001, FUTAMURA CHEMICAL CO., LTD.) may be used. The raw material slurry can be extended so that the thickness after drying becomes about 0.1 mm, which is equal to the thickness of normal cut tobacco.

(3) Cooling Before Dry-Forming of Slurry

In the preparation of the menthol-containing sheet of the present invention, the extended raw material slurry is once cooled before drying so that the slurry becomes a temperature enabling sufficient gelation of the slurry (40° C. or less) and avoiding breaking of emulsion due to freezing (0° C. or more), i.e., a temperature of 0 to 40° C., preferably 0 to 30° C., and more preferably 15 to 25° C. The raw material slurry before cooling has a temperature of 60 to 90° C., preferably a temperature of 75 to 85° C., and is in a sol state. The preliminary cooling may be performed by blowing the air or the cold air (e.g., 10° C.) generated by a spot cooler (e.g., Suiden SS-25DD-1) on the extended raw material slurry for 2 to 3 minutes. Alternatively, the preliminary cooling may be performed by contacting the extended raw material slurry with a tube through which the cooling medium (e.g., 10° C.) generated by a chilled water generator (a chiller, for example, APISTE PCU-1600R) is running, for 1 to 2 minutes. Alternatively, the preliminary cooling may be performed by allowing the extended raw material slurry to stand at room temperature.

As shown in Examples 4 and 9 below, once a solution of the polysaccharide listed above is cooled and forms gel, the solution has a property of being capable of maintaining the gel state without easily returning to a sol state even at the gel transition temperature even if the temperature is raised afterward. The above property is utilized in the present invention, and the preliminary cooling is performed before drying the raw material slurry. As a result, the polysaccharide contained in the raw material slurry after the preliminary cooling is hard to solate even if the temperature is raised at the time of drying, and the menthol coated with the polysaccharide is hard to volatilize. This is demonstrated in the present invention.

When the raw material slurry is extended on the substrate and cooled once, it is advantageous in that the extended raw material slurry is hard to deform even if it is exposed to high temperatures in the subsequent drying step.

Figure 4A:
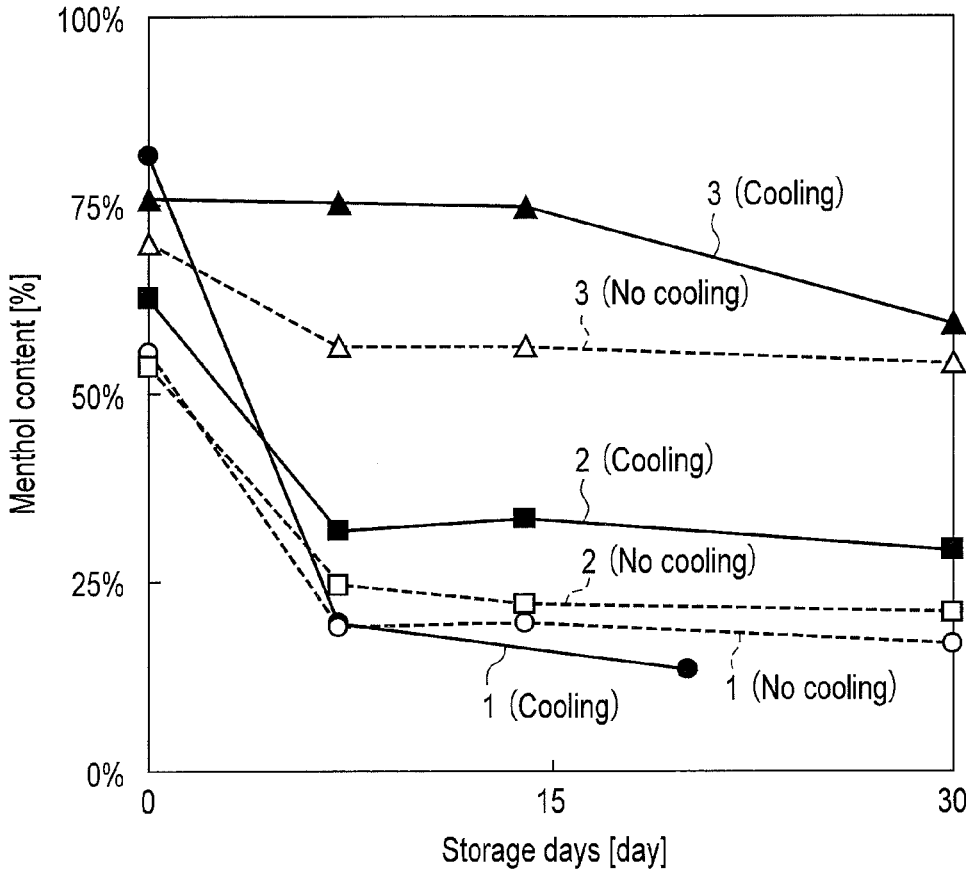
FIG. 4A is a graph showing cooling effects on the post-storage menthol content of the menthol-containing sheets (comparative examples).
Figure 4B:
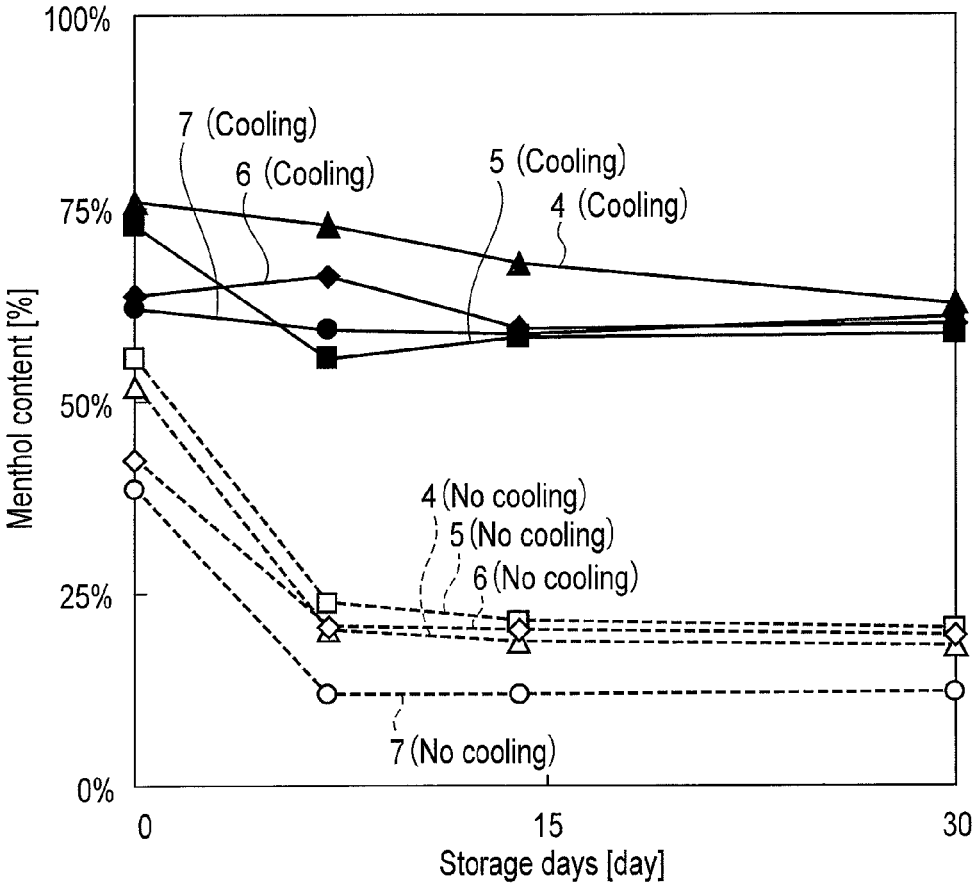
FIG. 4B is a graph showing cooling effects on the post-storage menthol content of the menthol-containing sheets (examples of the present invention).
Figure 5:
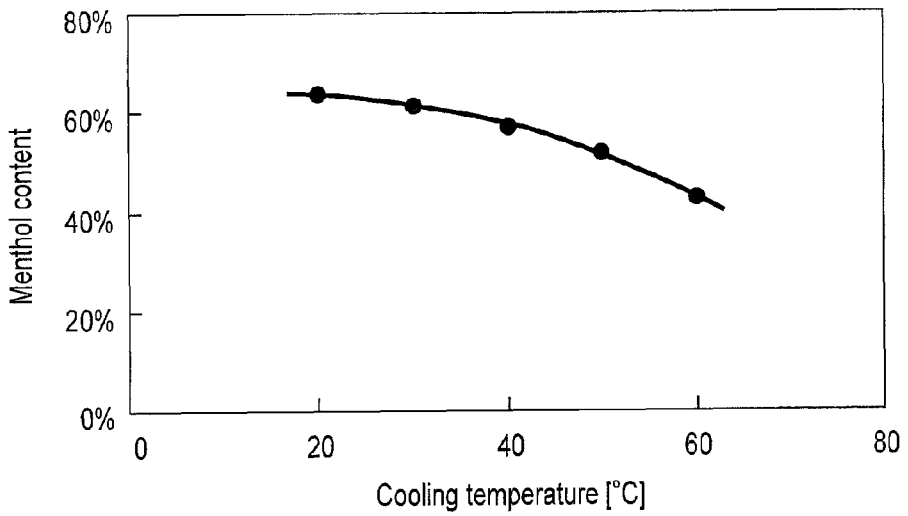
FIG. 5 is a graph showing a relationship between the cooling temperature and the menthol content of the menthol-containing sheets.

The cooling effect on the post-storage flavor-retaining property of the flavor-containing sheet (e.g., menthol-containing sheet) is demonstrated in Example 6 below (FIG. 4B). Lower cooling temperatures result in larger contents of menthol, which is demonstrated in Example 7 below (FIG. 5).

(4) Dry Forming of Slurry

The heat-drying of the extended and cooled raw material slurry can be performed by any type of heat-drying means such as a hot air drying or an infrared heat drying. Hereinafter, the "heat-drying" of the raw material slurry is simply referred to as "drying".

In the present invention, the drying of the raw material slurry includes drying by heating the cooled raw material slurry at a sample temperature of 70 to 100° C. Preferably, the sample temperature is 100° C. or less over the total drying time. If the slurry is dried at the above-mentioned sample temperature, the volatilization of menthol can be suppressed, and a menthol-containing sheet can be prepared in a shorter time.

The term "sample temperature" means a temperature on the surface of a sample (i.e., a slurry or a sheet). The term "total drying time" means a period to be heated in a heat-dryer. The total drying time is generally 20 minutes or less, preferably from 7 to 20 minutes, more preferably from 10 to 18 minutes.

In the present invention, the sample temperature may be less than 70° C. during the drying step. However, in order to shorten the drying time, it is preferable to short the period when the sample temperature is less than 70° C. In present invention, the sample temperature may exceed 100° C. during the drying step. However, in order to stably maintain the flavor such as menthol, it is preferable to short the period when the sample temperature exceeds 100° C. Therefore, the drying of the raw material slurry can be preferably performed by drying the cooled raw material slurry at a sample temperature of 70 to 100° C. for more than one-half of the total drying time. Preferably, the sample temperature is 100° C. or less over the total drying time. More preferably, the drying of the raw material slurry can be performed by drying the cooled raw material slurry at a sample temperature of 70 to 100° C. over the total drying time.

However, immediately after the heat-drying is started, the temperature of the sample in the heat-dryer is in the middle of increasing from the preliminary cooling temperature to a desired sample temperature (70° C.) and does not reach the desired sample temperature. When expressed as "at a sample temperature of 70 to 100° C. over the total drying time", the term "total drying time" means a total drying time excluding the beginning period when the sample temperature is in the middle of increasing to the desired sample temperature. For example, in Example 5 (FIGS. 3A to 3G) below, the sample temperature is in the middle of increasing to the desired sample temperature for about 1 minute after the start of heat-drying. Thus, the beginning period is excluded from the "total drying time", when expressed as "at a sample temperature of 70 to 100° C. over the total drying time".

Preferably, the drying of the raw material slurry can be performed by drying the raw material slurry so that a sheet form having a moisture content of less than 10% is prepared for a total drying time of 20 minutes or less.

In Example 5 below (FIGS. 3D to 3G), it is demonstrated that when the raw material slurry is dried at the above sample temperature, the sheet obtained by the drying can achieve a high post-storage flavor-retaining property.

Hereinafter, the case of hot air drying will be explained. In the case of hot air drying, in order to maintain a sample temperature of 70 to 100° C., the raw material slurry is preferably dried with hot air having a temperature of 100° C. or more at the time of initial drying, and then, with hot air having the same temperature as the initial drying or a temperature lower than the initial drying (preferably 70° C. or more and less than 100° C.). Accordingly, it is possible to suppress the sample temperature rise in the latter drying. For example, it is possible to keep the sample temperature so as not to exceed 100° C. over the total drying time.

In the present invention, it is possible that the prepared menthol-containing sheet has a high menthol content and a high yield of menthol, and maintains a high menthol content after storage, once the raw material slurry is cooled even if the subsequent drying step includes a drying process in which the sample temperature reaches 70 to 100° C. (e.g., high temperature drying with hot air having a temperature of 100° C. or more).

In the case of hot air drying, the hot air temperature may be a constant temperature in the whole period of the drying step or may be changed in the period of the drying step. When the hot air temperature is changed, the drying of the raw material slurry is preferably performed by the initial drying at a high temperature with hot air having a temperature of 100° C. or more and the latter drying at a low temperature with hot air having a temperature of less than 100° C. The term "initial drying" used herein means the first drying in the drying step with hot air having a temperature of 100° C. or more, and the term "latter drying" means the drying followed by the initial drying, with hot air having a low temperature of less than 100° C. Thus, if the initial drying with hot air having a high temperature is performed in combination with the latter drying with hot air having a low temperature, it is advantageous in that the sample temperature does not become too high. In the case of hot air drying, the temperature in the dryer is the same as the hot air temperature.

More preferably, the raw material slurry can be dried so that a sheet form having a moisture content of less than 10% is prepared for a total drying time of 20 minutes or less, by performing the initial drying at a hot air temperature of 100° C. or more for a quarter or more of the total drying time and then the latter drying at a hot air temperature of less than 100° C. for a quarter or more of the total drying time.

Thus, if the initial drying with hot air having a high temperature is performed in combination with the latter drying with hot air having a low temperature, it is possible to suppress the sample temperature rise in the latter drying. For example, it is possible to keep the sample temperature so as not to exceed 100° C. Accordingly, it is possible that the menthol-containing sheet of the present invention has a high menthol content after the sheet preparation and also maintains a high menthol content after storage (see Sample No. 4 of Example 1, Sample No. 5 of Example 2, and Sample No. 6 of Example 3 below).

When the raw material slurry is dried by hot air drying, the initial drying can be performed, for example, with hot air having a temperature of 100 to 130° C. for 4 to 6 minutes, and the latter drying can be performed, for example, with hot air having a temperature of 70° C. or more and less than 100° C. for 4 to 6 minutes. The air volume of hot air may be set to, for example, 3 to 20 m/sec. The total drying time is generally 20 minutes or less, preferably from 7 to 20 minutes, more preferably from 10 to 18 minutes.

The conditions of the initial drying and the latter drying (temperature, time, and air volume) can be appropriately set, for example, within the above range. For example, the initial drying is performed at a hot air temperature of 100 to 130° C. until the moisture of the surface of the raw material slurry is evaporated and a film is sufficiently formed on the surface of the slurry. Thereafter, the hot air temperature is immediately changed to a range of 70° C. or more and less than 100° C., and the latter drying can be performed.

The hot air temperature during the initial drying may be constant, or may be changed so as to sequentially decrease within a range of 100 to 130° C. The hot air temperature during the latter drying may be constant, or may be changed so as to sequentially decrease within a range of 70° C. or more and less than 100° C. For example, the hot air drying machine used in Examples below has three drying chambers and each sample is conveyed in the order of the first, second, and third chambers by a belt conveyor. Thus, the first and second chambers may be used for the initial drying at the same or different temperatures (100° C. or more) and the third chamber may be used for the latter drying (less than 100° C.). Alternatively, the first chamber is used for the initial drying (100° C. or more) and the second and third chambers may be used for the latter drying at the same or different temperatures (less than 100° C.)

In the present invention, the drying is performed until the menthol-containing sheet is sufficiently dried so that the sheet can be easily peeled off from a substrate and can be cut in the subsequent cutting step. Specifically, the drying is performed until the moisture content of the menthol-containing sheet reaches less than 10 wt %, preferably from 3 to 9 wt %, more preferably from 3 to 6 wt % (see Example 8 below). The term "moisture content" used herein means a value measured according to the measurement method described in the following examples.

Immediately after the preparation, the menthol content of the menthol-containing sheet of the present invention is preferably 45 wt % or more, more preferably from 55 to 75 wt %. After storage (at 50° C. for 30 days), the menthol content of the menthol-containing sheet of the present invention is preferably 45 wt % or more, more preferably from 48 to 63 wt %. The term "menthol content" used herein means a value measured according to the measurement method described in the following examples.

2. Smoking Article

The menthol-containing sheet of the present invention is cut into, for example, a size equal to that of normal cut tobacco, and thus the cut pieces can be blended with cut tobacco for the smoking article. The cut pieces of the menthol-containing sheet can be added in an amount of 2 to 10 g per 100 g of cut tobacco. The cut pieces of the menthol-containing sheet is preferably dispersed in the cut tobacco and blended with it.

The menthol-containing sheet of the present invention can be blended with cut tobacco of any type of smoking articles, for example, a burning type smoking article in which a smoker tastes the flavor of smoke by burning the tobacco leaves, particularly a cigarette. Particularly, the menthol-containing sheet of the present invention can be blended with cut tobacco of a cigarette comprising a cigarette rod which includes cut tobacco and a cigarette paper wrapped around the cut tobacco.

EXAMPLES

Example 1

(1) Preparation of Raw Material Slurry (10 L Scale)

Water 10 L

Gellan gum (KELCOGEL, San-Ei Gen F.F.I., Inc.) 150 g

Tamarind gum (BISTOP D-2032, San-Ei Gen F.F.I., Inc.) 150 g

Lecithin (SUN LECITHIN A-1, Taiyo Kagaku Co., Ltd.) 120 mL (5% aqueous solution)

Menthol (Takasago International Corporation.) 1500 g

Water (10 L) was kept at 80° C., and gellan gum (150 g) and tamarind gum (150 g) were added and dissolved therein in small portions so as not to form lumps (the time required: about 20 minutes), while stirring them with a mixer (PRIMIX T.K. AUTO MIXER Model 40/equipped with a rotor for stirring a solution/2000 rpm), and menthol (1500 g) was added.

The stirring mixer was replaced with a homogenizer (PRIMIX T.K. AUTO MIXER Model 40/equipped with a rotor-stator head/4000 rpm) and the mixture was emulsified for 10 minutes. Then, lecithin (120 mL of 5% aqueous solution) was added thereto, followed by emulsification for 10 minutes to prepare a raw material slurry.

(2) Dry Forming

The obtained raw material slurry was extruded on a base film through a slit die. After that, the cold air generated by a spot cooler (Suiden SS-25DD-1) (10° C.) was blown on the raw material slurry for 2 to 3 minutes so that the raw material slurry was cooled to about 20° C. After that, it was dried with hot air by carrying it on the belt conveyor in the hot-air drying machine to obtain a menthol-containing sheet in film form. The details of the experiment will be described below.

Slit die: vertical slit die (which was heated at 60° C. and kept warm), 900 μm in thickness and 20 cm in width Base film: PET film (which was surface corona treated), 50 μm in thickness Hot air drying machine: hot air type of a dry forming machine having the following configuration Drying compartment: three chambers (each zone length: 2.5 m, total length: 7.5 m)

Air volume and form of hot air:

First chamber: perforated plate, air volume: 5 m/sec.

Second chamber: perforated plate, air volume: 10 m/sec.

Third chamber: floating jet, air volume: 20 m/sec.

In the first and second chambers, hot air was blown on the menthol-containing sheet which was conveyed on the belt, through a perforated plate which functions as a flow control plate. In the third chamber, hot air was blown on the menthol-containing sheet which was conveyed while floating together with a base film by upward and downward ventilation.

The hot air drying conditions were changed as described in Table 1 below to prepare menthol-containing sheets of Sample Nos. 1 to 4. The temperature described in the table are hot air temperature. The drying time was set so that the menthol-containing sheet was sufficiently dried, can be easily peeled off from the base film, and can be cut in the subsequent cutting step. The moisture content of the menthol-containing sheets obtained in this example was about 3%.

(3) Measurement of Dry State of Menthol-Containing Sheet

The moisture content of the menthol-containing sheet was measured by the GC-TCD as follows.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (without diluting for the GC measurement).

The measurement solution was analyzed by the GC-TCD and quantified by the calibration curve method.

GC-TCD; 6890 gas chromatograph, manufactured by Hewlett Packard

Column; HP Polapack Q (packed column) Constant Flow mode 20.0 mL/min

Injection; 1.0 μL

Inlet; EPC purge packed column inlet

Heater; 230° C.

Gas; He

Total flow; 21.1 mL/min

Oven; 160° C. (hold 4.5 min)→(60° C./min)→220° C. (hold 4.0 min)

Detector; TCD detector Reference gas (He) flow rate; 20 mL/min Make up gas (He) 3.0 mL/min Signal rate; 5 Hz Concentrations of calibration curve solutions; six points of 0, 1, 3, 5, 10 and 20 [mg-H2O/10 mL]

(4) Measurement of Menthol Content of Menthol-Containing Sheet

The menthol content of menthol-containing sheets was measured with GC-FID in the following manner.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (by 10-fold diluting it with methanol for the GC measurement).

The measurement solution was analyzed by the GC-FID and quantified by the calibration curve method.

GC-FID; 6890N gas chromatograph, manufactured by Agilent

Column; DB-WAX 30 m×530 μm×1 μm

Constant Pressure mode 5.5 psi (velocity; 50 cm/sec)

Injection; 1.0 μL

Inlet; Spritless mode 250° C. 5.5 psi

Oven; 80° C.→(10° C./min)→170° C. (hold 6.0 min) [Max 220° C.]

Detector; FID detector 250° C. (H2; 40 mL/min air; 450 mL/min)

Signal rate; 20 Hz

Concentrations of calibration curve solutions; eight points of 0, 0.01, 0.05, 0.1, 0.3, 0.5, 0.7 and 1.0 [mg-menthol/mL]

The menthol content (mg) of the prepared menthol-containing sheet and the menthol content (mg) of the menthol-containing sheet stored in the accelerated environments were measured. The results are shown in Table 1 as the "initial menthol content (%)" and the "post-storage menthol content (%)".

Initial menthol content (%)={measured value of the menthol content (mg)/weight of the menthol-containing sheet (mg)}×100

Post-storage menthol content (%)={measured value of the menthol content (mg)/weight of the menthol-containing sheet (mg)}×100

The accelerated environments were as follows.

About 5 g of a menthol-containing sheet (cut into 1×10 mm pieces) was placed in an open container, and it was stored for a maximum of 30 days in a thermostat (Drying Oven DX600, Yamato Scientific Co., Ltd.) set at 50° C.

The menthol flavor retention rate was calculated from the value of the menthol content using the following equation, and the flavor retention ability of the menthol-containing sheet was evaluated.

Menthol flavor retention rate (%)={(post-storage menthol content)/(initial menthol content)}×100

(5) Results

The menthol-containing sheets of Sample Nos. 1 to 4 were prepared with the hot air drying machine under the hot air drying conditions described in Table 1. The moisture content and initial menthol content of the menthol-containing sheets were measured according to the above procedure. The results are shown in Table 1. The menthol content of the sheet stored for 30 days is shown in Table 1. The menthol content of the sheet stored for 7 days, 14 days and 30 days is shown in FIG. 1. The reference numerals 1 to 7 in FIG. 1 represent Sample Nos. 1 to 7.

TABLE 1

| Sample Nos. | 1 | 2 | 3 | 4 |
|---|---|---|---|---|
| Hot air drying conditions | | | | |
| First chamber | 70° C. · 4 min | 120° C. · 2 min | 70° C. · 20 min | 120° C. · 2.5 min |
| Second chamber | 80° C. · 4 min | 130° C. · 2 min | 70° C. · 20 min | 120° C. · 2.5 min |

TABLE 1-continued

| Sample Nos. | 1 | 2 | 3 | 4 |
|---|---|---|---|---|
| Third chamber | 120° C. · 4 min | 176° C. · 2 min | 70° C. · 20 min | 70° C. · 2.5 min |
| Belt speed | 0.6 m/min | 1.3 m/min | 0.13 m/min | 1.0 m/min |
| Moisture content | 3.1% | 3.2% | 3.1% | 3.4% |
| Initial menthol content | 81.5% | 62.4% | 75.8% | 75.7% |
| Post-storage menthol content | 13.6% (20 days later) | 29.2% (30 days later) | 59.2% (30 days later) | 62.4% (30 days later) |
| Flavor retention rate | 17% | 47% | 78% | 82% |

Sample No. 1

When the raw material slurry is extended and dried with the hot air drying machine to form a sheet shape, in many cases, hot air drying is started at a low temperature (about 70° C.) so as not to form a surface coating in the first-half drying, and the hot air drying is continued at a high temperature (about 120° C.) so as to achieve the complete drying in the second-half drying. In accordance with this drying procedure, the menthol-containing sheet of Sample No. 1 was prepared, and as a result, a sufficiently dried sample (moisture content: 3.1%) can be prepared for a total drying time of 12 minutes. The "initial menthol content" after sheet preparation was as high as 81.5%, but the "post-storage menthol content" after stored (for 20 days) in the accelerated environments was as low as 13.6%. Thus, the sheet of Sample No. 1 had a problem in a post-storage flavor-retaining property.

Sample No. 2

In Sample No. 2, high drying temperatures were employed to make the drying time shorter than that of Sample No. 1. As a result, in Sample No. 2, a sufficiently dried sample (moisture content: 3.2%) can be prepared for a total drying time of 6 minutes. The "initial menthol content" after sheet preparation was as high as 62.4%, but the "post-storage menthol content" after stored (for 30 days) in the accelerated environments was as low as 29.2%. Thus, the sheet of Sample No. 2 had a problem in a post-storage flavor-retaining property.

Sample No. 3

In Sample No. 3, the hot air temperature was set to 70° C. in the whole period of the drying step. As a result, in Sample No. 3, a sufficiently dried sample (moisture content: 3.1%) can be prepared for a total drying time of 60 minutes. The "initial menthol content" after sheet preparation was as high as 75.8%, and the "post-storage menthol content" after stored (for 30 days) in the accelerated environments was also as high as 59.2%. Thus, both of flavor-retaining property after sheet preparation and post-storage flavor-retaining property were excellent. However, the time required for drying was as long as 60 minutes. Sample No. 4

In Sample No. 4, in contrast to Sample Nos. 1 and 2 in which the low temperature drying was shifted to the high temperature drying, the initial drying (in the first and second chambers) was performed by hot air at a high temperature (120° C.) and the latter drying (in the third chamber) was performed by hot air at a low temperature (70° C.). In Sample No. 4, the total drying time was as short as 7.5 minutes, however a sufficiently dried sample (moisture content: 3.4%) can be prepared. The "initial menthol content" after sheet preparation was as high as 75.7%, and the "post-storage menthol content" after stored (for 30 days) in the accelerated environments was also as high as 62.4%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 2

The menthol-containing sheet of Sample No. 5 was prepared in a similar manner to that of Example 1, except that the slurry was dried under the hot air drying conditions described in Table 2 below, and the moisture content and the menthol content were measured. The results are shown in Table 2.

TABLE 2

| Sample No. | 5 |
|---|---|
| Hot air drying conditions | |
| First chamber | 120° C. · 4 min [Floating jet 20 m/sec] |
| Second chamber | 70° C. · 4 min [Jet 20 m/sec] |
| Third chamber | 70° C. · 4 min [Jet 10 m/sec] |
| Belt speed | 0.6 m/min |
| Moisture content | 3.1% |
| Initial menthol content | 72.7% |
| Post-storage menthol content | 58.5% |
| Flavor retention rate | 80% |

In Sample No. 5, the volume of the hot air was increased as compared to those of Sample Nos. 1 to 4. In the first chamber, hot air was blown on the menthol-containing sheet which was conveyed while floating by upward and downward ventilation. In the second and third chambers, hot air was blown on the menthol-containing sheet which was conveyed on the belt by ventilation.

In Sample No. 5, the initial drying (in the first chamber) was performed by hot air at a high temperature (120° C.) for 4 minutes and the latter drying (in the second and third chambers) was performed by hot air at a low temperature (70° C.) for 8 minutes. In Sample No. 5, a sufficiently dried sample (moisture content: 3.1%) can be prepared for a total drying time of 12 minutes. The "initial menthol content" after sheet preparation was as high as 72.7%, and the "post-storage menthol content" after stored (for 30 days) in the accelerated environments was also as high as 58.5%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 3

The menthol-containing sheets of Sample Nos. 6 and 7 were prepared in a similar manner to that of Example 1, except that the slurry was dried using a hot air drying machine having four chambers of drying compartment under the hot air drying conditions described in Table 3 below, and the moisture content and the menthol content were measured. The results are shown in Table 3.

TABLE 3

| Sample Nos. | 6 | 7 |
|---|---|---|
| Hot air drying conditions | | |
| First chamber | 110° C. · 2.2 min [Jet 10 m/sec] | 100° C. · 2.2 min [Jet 10 m/sec] |
| Second chamber | 100° C. · 2.2 min [Jet 10 m/sec] | 100° C. · 2.2 min [Jet 10 m/sec] |
| Third chamber | 100° C. · 2.2 min [Jet 10 m/sec] | 100° C. · 2.2 min [Jet 10 m/sec] |
| Fourth chamber | 80° C. · 2.2 min [Jet 10 m/sec] | 100° C. · 2.2 min [Jet 10 m/sec] |
| Belt speed | 0.9 m/min | 0.9 m/min |
| Moisture content | 5% | 4.9% |
| Initial menthol content | 63.5% | 61.9% |
| Post-storage menthol content | 59.9% (30 days later) | 60.8% (30 days later) |
| Flavor retention rate | 94% | 98% |

In Sample Nos. 6 and 7, menthol-containing sheets were prepared using a hot air drying machine having four chambers of drying compartment.

In Sample No. 6, the initial drying (in the first to third chambers) was performed by hot air at a high temperature (110° C.→100° C.) for 6.6 minutes, and the latter drying (in the fourth chamber) was performed by hot air at a low temperature (80° C.) for 2.2 minutes. In Sample No. 6, a sufficiently dried sample (moisture content: 5%) can be prepared for a total drying time of 8.8 minutes. The "initial menthol content" after sheet preparation was as high as 63.5%, and the "post-storage menthol content" after stored (for 30 days) in the accelerated environments was also as high as 59.9%. Thus, both of flavor-retaining property after sheet preparation and post-storage flavor-retaining property were excellent. The results show that it was possible to prepare a sheet having an excellent flavor-retaining property in a relatively short drying time by employing the initial high temperature drying and the latter low temperature drying, though the hot air temperature sequentially is reduced from 110° C. to 100° C. during the initial drying.

In Sample No. 7, the hot air temperature was set to 100° C. in the whole period of the drying step, regardless of the initial drying and the latter drying. In Sample No. 7, the latter drying at a low temperature was not employed, but it is assumed that the sample temperature did not become too high in the process of drying the slurry due to the presence of the moisture in the sample, similarly to Sample Nos. 4 to 6. Specifically, in Sample No. 7, a sufficiently dried sample (moisture content: 4.9%) can be prepared for a total drying time of 8.8 minutes. The "initial menthol content" after sheet preparation was as high as 61.9%, and the "post-storage menthol content" after stored (for 30 days) in the accelerated environments was also as high as 60.8%. Thus, both of flavor-retaining property after sheet preparation and post-storage flavor-retaining property were excellent. The results show that it was possible to prepare a sheet having an excellent flavor-retaining property in a relatively short drying time, similarly to the cases of Sample Nos. 4 to 6, though the same hot air temperature (100° C.) was employed in the whole period of the drying step.

Example 4

In this example, temperature-responsive sol-gel transition characteristics of a polysaccharide solution (slurry) were examined.

Water 0.1 L

Gellan gum (KELCOGEL, San-Ei Gen F.F.I., Inc.) 5 g

Water (0.1 L) was kept at 70° C., and gellan gum (5 g) was added and dissolved therein in small portions so as not to form lumps, while stirring them using a high-performance mixer DMM (ATEC Japan Co., Ltd.), and a polysaccharide solution (slurry) was prepared.

Figure 2A:
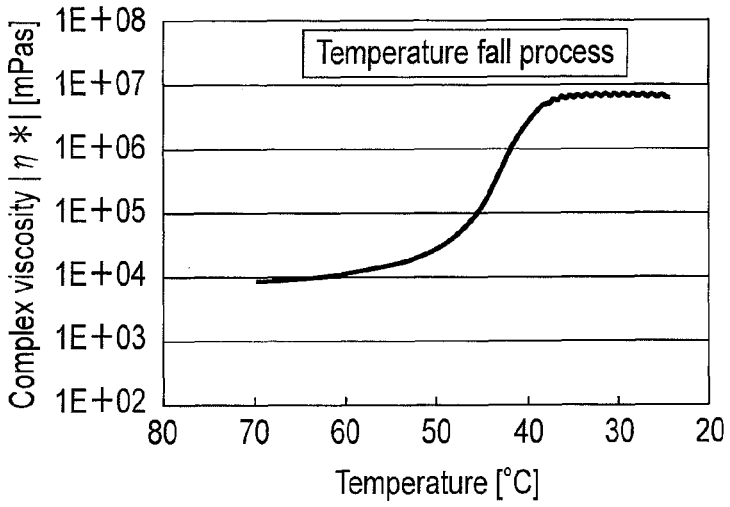
FIG. 2A is a graph showing changes in the viscosity followed by a fall in the temperature of aqueous gellan gum solution.
Figure 2B:
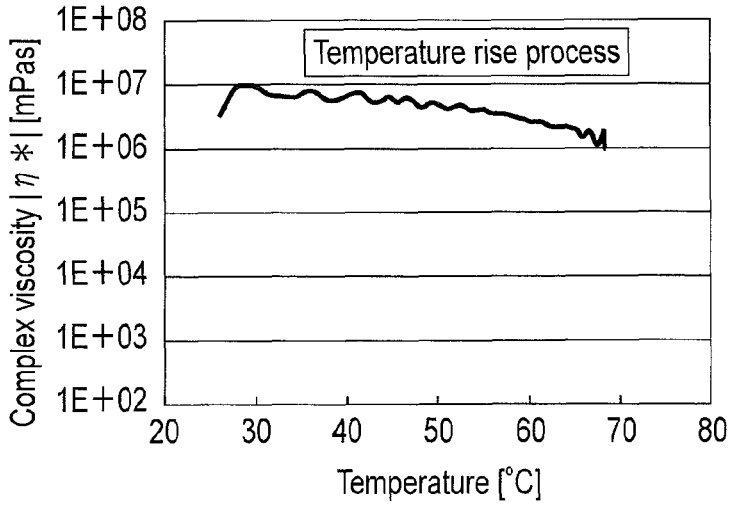
FIG. 2B is a graph showing changes in the viscosity followed by a rise in the temperature of aqueous gellan gum solution.

The temperature of the obtained slurry (70° C.) was decreased to 25° C. for about 900 seconds (0.05° C./sec.). Thereafter, the temperature was raised to 70° C. for about 900 seconds. FIGS. 2A and 2B show how the viscosity (fluidity) of the slurry was changed by the temperature change.

As shown in FIG. 2A, if the temperature of the slurry was decreased to 25° C. (cooling), the viscosity was low up to a temperature of 50° C. (the fluidity was high). However, the viscosity was suddenly increased at 40° C. or less (gelation phenomenon). If the temperature of the obtained gel was raised, the gel did not easily return to a sol state even if the temperature exceeded the gelation temperature (40° C.), as shown in FIG. 2B. Thus, the gel state was maintained up to a considerably high temperature.

The result shows that once the slurry containing polysaccharide is cooled and forms gel, the slurry is hard to return to a sol state even if the temperature is raised afterward, and thus the gel state can be maintained. The above property of the polysaccharide is utilized in the present invention, and the preliminary cooling is performed before drying the raw material slurry. As a result, it is expected that the polysaccharide contained in the raw material slurry after the preliminary cooling is hard to solate even if the temperature is raised at the time of drying, and the menthol coated with the polysaccharide is hard to volatilize.

Example 5

In this example, the sheets of Sample Nos. 1 to 7 were prepared as described in the Examples 1 to 3, and the temperature of the samples was measured during the drying step. Regarding the hot air drying conditions of the samples of Sample Nos. 1 to 7, it can be referred to Tables 1 to 3.

The measurement of the sample temperature was performed by directly measuring each sample (slurry) in the middle of the drying step using a non-contact thermometer (PT-7LD, manufactured by, OPTEX CO., LTD).

The measurement results of Sample Nos. 1 to 7 are shown in FIGS. 3A to 3G, respectively. In FIGS. 3A to 3G, the term "Cooling" means a sample prepared by blowing cold air (10° C.) on a slurry before the drying step and cooling to about 20° C., while the term "No cooling" means a sample prepared by casting a slurry and immediately drying it without performing the cooling process. The results of FIGS. 3A to 3G show that the cooling of the slurry does not affect on the temperature of each sample during the drying step.

Figure 3A:
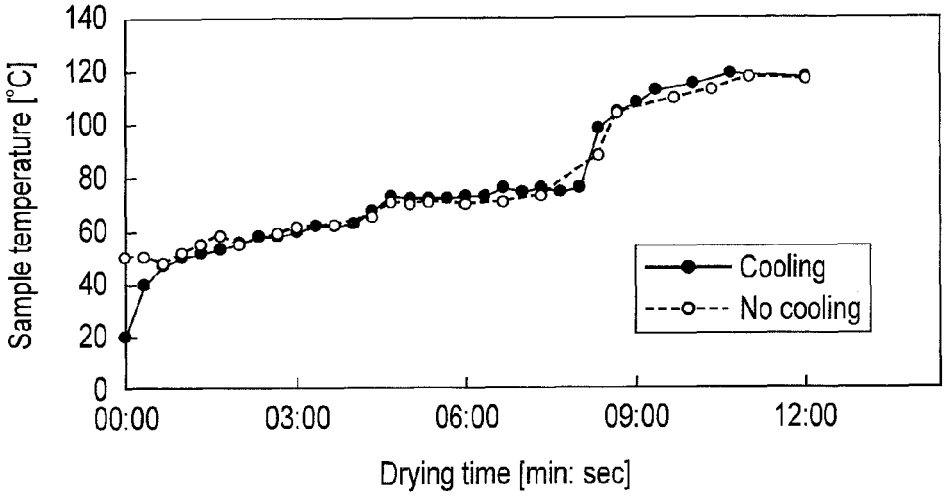
FIG. 3A is a graph showing the sample temperature of Sample No. 1 during the heat-drying step.

In Sample No. 1, the following hot air drying conditions were employed: at a hot air temperature of 70° C. for 4 minutes, at a hot air temperature of 80° C. for 4 minutes, and at a hot air temperature of 120° C. for 4 minutes. The sample temperature increased following a rise in hot air temperature. Finally, it exceeded 100° C. and reached nearly 120° C. (FIG. 3A). As shown, the "post-storage menthol content" of the sheet of Sample No. 1 is as low as 13.6% (Table 1). It is estimated that the internal structure of the sheet was destroyed by the high sample temperature and thus the post-storage menthol content was reduced.

Figure 3B:
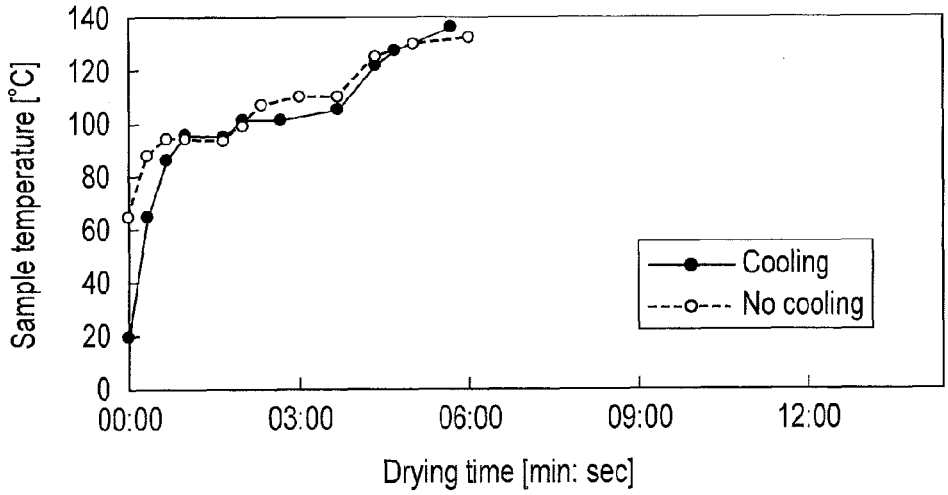
FIG. 3B is a graph showing the sample temperature of Sample No. 2 during the heat-drying step.

In Sample No. 2, the following hot air drying conditions were employed: at a hot air temperature of 120° C. for 2 minutes, at a hot air temperature of 130° C. for 2 minutes, and at a hot air temperature of 176° C. for 2 minutes. The sample temperature increased following a rise in hot air temperature. Finally, it exceeded 100° C. and reached nearly 140° C. (FIG. 3B). As shown, the "post-storage menthol content" of the sheet of Sample No. 2 is as low as 29.2% (Table 1). It is estimated that the internal structure of the sheet was destroyed by the high sample temperature and thus the post-storage menthol content was reduced.

Figure 3C:
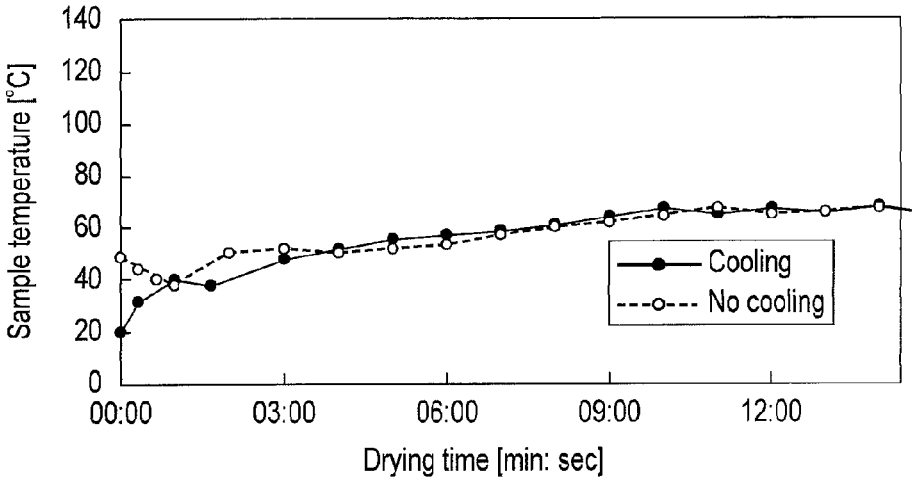
FIG. 3C is a graph showing the sample temperature of Sample No. 3 during the heat-drying step.

In Sample No. 3, the hot air drying at a hot air temperature of 70° C. for 60 minutes was employed as the hot air drying conditions. FIG. 3C shows the sample temperature from the start of drying to 14 minutes after drying. The sample temperature did not exceed 70° C. over the total drying time. As shown, the "post-storage menthol content" of the sheet of Sample No. 3 is as high as 59.2% (Table 1). It is estimated that the sheet of Sample No. 3 did not reach a high temperature over the total drying time and thus the high menthol content can be maintained after storage in the accelerated environments. However, the sheet of Sample No. 3 was dried at a sample temperature of less than 70° C., and thus 60 minutes were necessary for the drying.

Figure 3D:
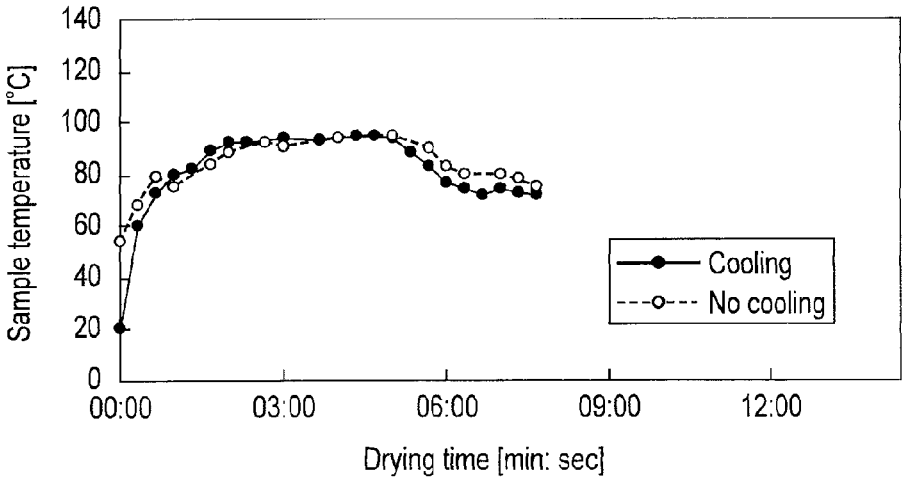
FIG. 3D is a graph showing the sample temperature of Sample No. 4 during the heat-drying step.

In Sample No. 4, the following hot air drying conditions were employed: at a hot air temperature of 120° C. for 5 minutes and at a hot air temperature of 70° C. for 2.5 minutes. The sample temperature reached up to 95° C. under the hot air of 120° C., and decreased to 72° C. under the hot air of 70° C. (FIG. 3D). As shown, the "post-storage menthol content" of the sheet of Sample No. 4 is as high as 62.4% (Table 1). It is estimated that the sheet of Sample No. 4 was kept at a sample temperature lower than those of Sample Nos. 1 and 2 over the total drying time and thus the high menthol content can be maintained after storage in the accelerated environments.

Figure 3E:
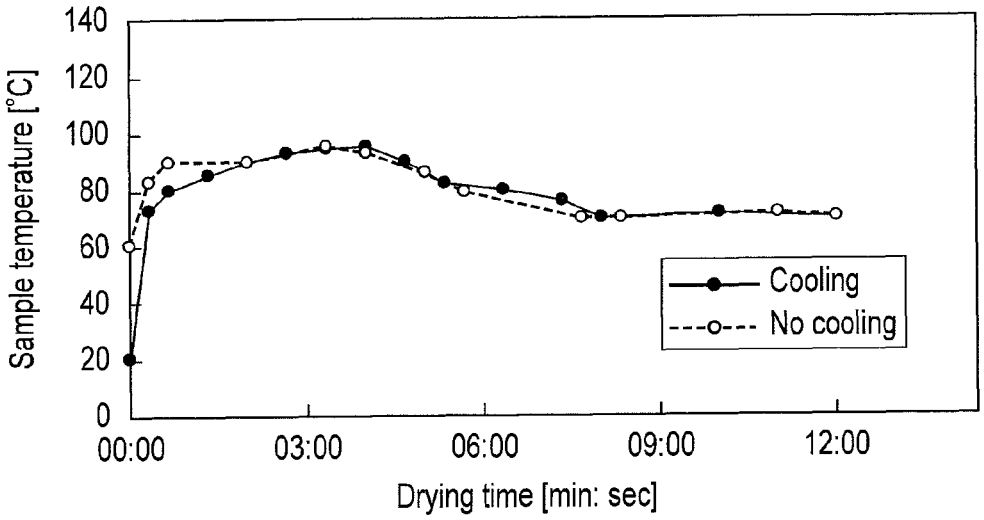
FIG. 3E is a graph showing the sample temperature of Sample No. 5 during the heat-drying step.

In Sample No. 5, the following hot air drying conditions were employed: at a hot air temperature of 120° C. for 4 minutes and at a hot air temperature of 70° C. for 8 minutes. The sample temperature reached up to 95° C. under the hot air of 120° C., and decreased to 70° C. under the hot air of 70° C. (FIG. 3E). As shown, the "post-storage menthol content" of the sheet of Sample No. 5 is as high as 58.5% (Table 2). It is estimated that the sheet of Sample No. 5 was kept at a sample temperature lower than those of Sample Nos. 1 and 2 over the total drying time and thus the high menthol content can be maintained after storage in the accelerated environments.

Figure 3F:
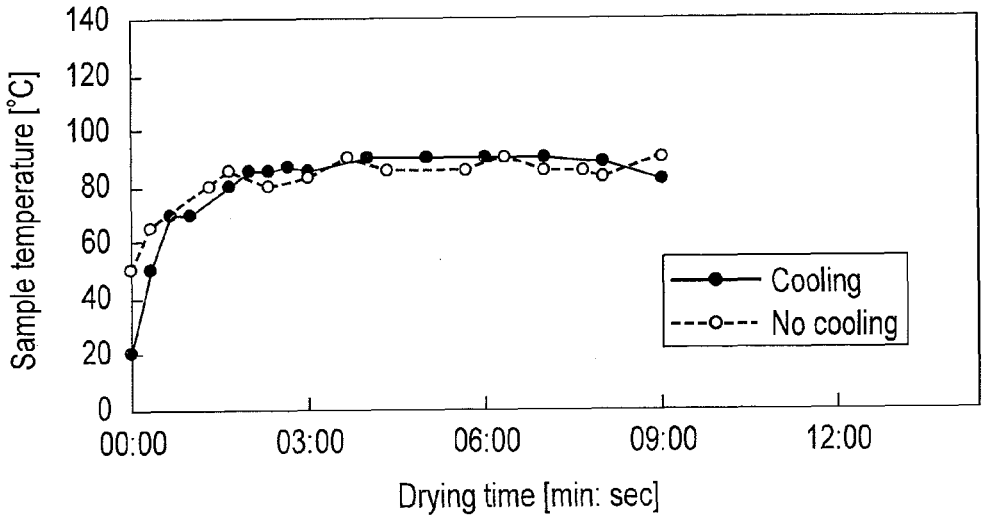
FIG. 3F is a graph showing the sample temperature of Sample No. 6 during the heat-drying step.

In Sample No. 6, the following hot air drying conditions were employed: at a hot air temperature of 110° C. for 2.2 minutes, at a hot air temperature of 100° C. for 4.4 minutes, and at a hot air temperature of 80° C. for 2.2 minutes. The sample temperature was maintained within a range of about 80 to 90° C. (FIG. 3F). As shown, the "post-storage menthol content" of the sheet of Sample No. 6 is as high as 59.9% (Table 3). It is estimated that the sheet of Sample No. 6 was kept at a sample temperature lower than those of Sample Nos. 1 and 2 over the total drying time and thus the high menthol content can be maintained after storage in the accelerated environments.

Figure 3G:
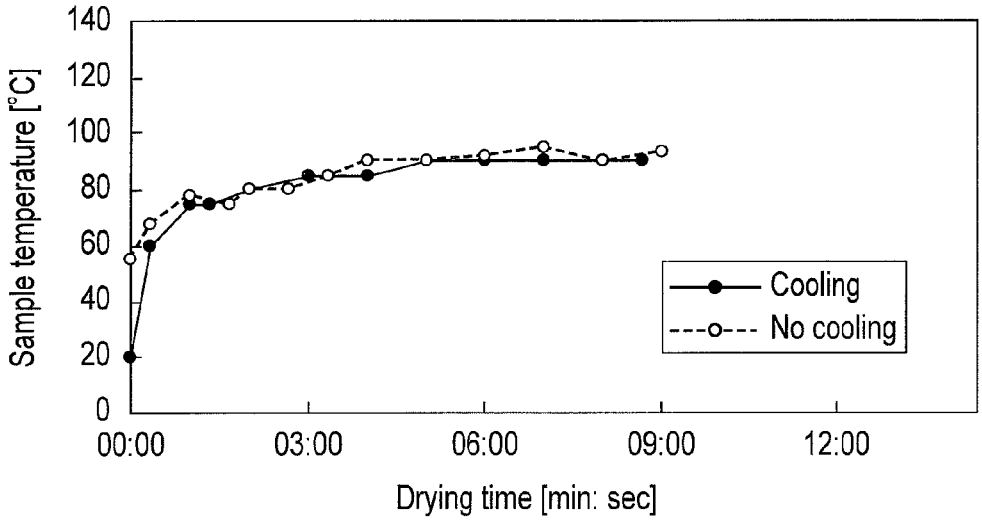
FIG. 3G is a graph showing the sample temperature of Sample No. 7 during the heat-drying step.

In Sample No. 7, the hot air drying at a hot air temperature of 100° C. for 8.8 minutes were employed as the hot air drying conditions. The sample temperature was maintained within a range of about 80 to 90° C. (FIG. 3G). As shown, the "post-storage menthol content" of the sheet of Sample No. 7 is as high as 60.8% (Table 3). It is estimated that the sheet of Sample No. 7 was kept at a sample temperature lower than those of Sample Nos. 1 and 2 over the total drying time and thus the high menthol content can be maintained after storage in the accelerated environments.

The above results show that if the slurry is dried at a sample temperature which does not exceed 100° C. over the total drying time, a high "post-storage menthol content" can be maintained. Further, it is found that if the slurry is dried at a sample temperature of 70 to 100° C. over the total drying time (except for about 1 minute at the beginning of the drying time), it is possible to form a menthol-containing sheet in a shorter time.

Example 6

In this example, it is demonstrated that the slurry cooling process before the drying step has an effect on the "post-storage menthol content" of the menthol-containing sheets. Specifically, the sheets of Sample Nos. 1 to 7 were prepared as described in Examples 1 to 3. In each of the sheets of Sample Nos. 1 to 7, the "post-storage menthol content" of the sheet prepared through the slurry cooling process was compared with the "post-storage menthol content" of the sheet prepared without the slurry cooling process. As described in Example 1, each sheet was stored in the thermostat set at 50° C. for 7, 14, and 30 days.

The measurement results of Sample Nos. 1 to 3 are shown in FIG. 4A and the measurement results of Sample Nos. 4 to 7 are shown in FIG. 4B. In FIGS. 4A and 4B, the term "Cooling" means a sample prepared by blowing cold air (10° C.) on a slurry before the drying step and cooling to about 20° C., while the term "No cooling" means a sample prepared by casting a slurry and immediately drying it without performing the cooling process. In the samples of "No cooling", the slurry temperature was not less than 50° C. during the casting and drying of the slurry.

The data of "Cooling" in FIGS. 4A and 4B are the same as those in FIG. 1.

In the sheets of Sample Nos. 1 and 2, the menthol content after storage for 30 days was low without reaching 30%, regardless of the presence or absence of the cooling process.

In the sheets of Sample No. 3, the menthol content after storage for 30 days was greater than 50%, regardless of the presence or absence of the cooling process. However, the drying time of 60 minutes was necessary for preparing the sheet of Sample No. 3.

In the sheets of Sample No. 4, the menthol content after storage for 30 days was decreased to 18% in the case of "No cooling", while the menthol content after storage for 30 days was maintained to 62% in the case of "Cooling".

In the sheets of Sample No. 5, the menthol content after storage for 30 days was decreased to 20% in the case of "No cooling", while the menthol content after storage for 30 days was maintained to 59% in the case of "Cooling".

In the sheets of Sample No. 6, the menthol content after storage for 30 days was decreased to 20% in the case of "No cooling", while the menthol content after storage for 30 days was maintained to 60% in the case of "Cooling".

In the sheets of Sample No. 7, the menthol content after storage for 30 days was decreased to 12% in the case of "No cooling", while the menthol content after storage for 30 days was maintained to 61% in the case of "Cooling".

The above results show that when the raw material slurry is once cooled and dried at a sample temperature of 70 to 100° C. to prepare a menthol-containing sheet, it is possible to form the sheet in a shorter time and keep the post-storage menthol content high.

Example 7

In this example, a relationship between the cooling temperature of the slurry and the "initial menthol content" of the menthol-containing sheets was examined. Specifically, in the sheet of Sample No. 6 described in Example 3, the cooling temperature of the slurry was changed to 20° C., 30° C., 40° C., 50° C., and 60° C., and various sheets were prepared. The menthol content of the sheet immediately after preparation, i.e., "initial menthol content" was measured.

The measurement results are shown in FIG. 5. From the results of FIG. 5, it was observed that the menthol content of the sheet tended to increase as the cooling temperature was lower. Specifically, the sheets showed the following initial menthol content: 64% when the cooling temperature was 20° C., 61% when the cooling temperature was 30° C., 57% when the cooling temperature was 40° C., 52% when the cooling temperature was 50° C., and 43% when the cooling temperature was 60° C.

In Example 4 described above, it is shown that the slurry forms gel at a cooling temperature of 40° C. or less, and that once the slurry containing polysaccharide is cooled and forms gel, the slurry is hard to return to a sol state even if the temperature is raised afterward. Further, it is generally known that if the temperature of the emulsion is less than 0° C., the emulsion is frozen and destroyed.

From these results, it is found that cooling temperatures is preferably 0 to 40° C., more preferably 0 to 30° C.

Example 8

In this example, a relationship between the moisture content of the menthol-containing sheets and the menthol flavor retention rate was examined. Specifically, in the sheet of Sample No. 6 described in Example 3, the total drying time of the slurry was changed to 8.16 minutes, 7.92 minutes, 7.64 minutes, 7.44 minutes, and 7.08 minutes by increasing the conveying speed of the belt in the hot air drying machine, and sheets having various moisture contents were prepared. The moisture content of the prepared sheets was measured. The preparation conditions and moisture content of the sheets are shown in Table 4 below.

TABLE 4

| Sample Nos. | 8-1 | 8-2 | 8-3 | 8-4 | 8-5 |
|---|---|---|---|---|---|
| Belt conveying speed | 1.13 m/min | 1.07 m/min | 1.04 m/min | 1.01 m/min | 0.98 m/min |
| Total drying time | 7.08 min | 7.44 min | 7.64 min | 7.92 min | 8.16 min |
| Moisture content after drying | 22.6 wt % | 14.6 wt % | 11.2 wt % | 8.6 wt % | 6.1 wt % |

The prepared sheets were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored immediately after preparation". The menthol flavor retention rate was calculated from the values of the menthol content using Equation below.

$$\text{Menthol flavor retention rate (\%)}=\{(\text{post-storage menthol content})/(\text{initial menthol content})\}\times 100$$

Figure 6:
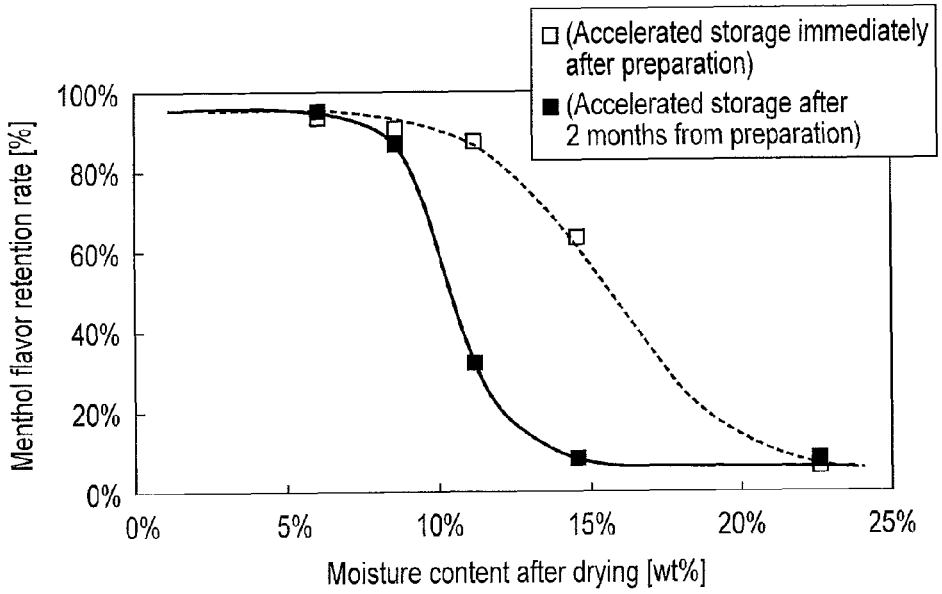
FIG. 6 is a graph showing a relationship between the moisture content of the menthol-containing sheets and the menthol flavor retention rate.

The results are shown in FIG. 6 as "the accelerated storage immediately after preparation".

Further, the sheets were allowed to stand for 2 months after preparation, and they were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored after 2 months from preparation". The menthol flavor retention rate was calculated by the above equation. The results are shown in FIG. 6 as "the accelerated storage after 2 months from preparation".

TABLE 5

| Sample Nos. | 8-1 | 8-2 | 8-3 | 8-4 | 8-5 |
|---|---|---|---|---|---|
| Moisture content after drying | 22.6 wt % | 14.6 wt % | 11.2 wt % | 8.6 wt % | 6.1 wt % |
| Initial menthol content | 51.0% | 56.5% | 59.5% | 62.2% | 61.0% |
| Menthol content of sheets stored immediately after preparation | 3.0% | 35.6% | 51.9% | 56.3% | 56.8% |
| Menthol content of sheets stored after 2 months from preparation | 3.9% | 4.4% | 18.1% | 50.2% | 56.8% |

The menthol content of the sheet immediately after preparation was about 50 to 60% in all the cases of Sample Nos. 8-1 to 8-5.

In the experiments in which the sheets immediately after preparation were stored in the accelerated environments, the following results was shown: the sheet (Sample No. 8-5) having a moisture content of about 6% had a menthol flavor retention rate of 93%, the sheet (Sample No. 8-4) having a moisture content of about 9% had a menthol flavor retention rate of 90%, the sheet (Sample No. 8-3) having a moisture content of about 11% had a menthol flavor retention rate of 87%, the sheet (Sample No. 8-2) having a moisture content of about 15% had a menthol flavor retention rate of 63%, and the sheet (Sample No. 8-1) having a moisture content of about 23% had a menthol flavor retention rate of 6%.

In the experiments in which the sheets after 2 months from preparation were stored in the accelerated environments, the following results were shown: the sheet (Sample No. 8-5) having a moisture content of about 6% had a menthol flavor retention rate of 95%, the sheet (Sample No. 8-4) having a moisture content of about 9% had a menthol flavor retention rate of 87%, the sheet (Sample No. 8-3) having a moisture content of about 11% had a menthol flavor retention rate of 32%, the sheet (Sample No. 8-2) having a moisture content of about 15% had a menthol flavor retention rate of 8%, and the sheet (Sample No. 8-1) having a moisture content of about 23% had a menthol flavor retention rate of 8%.

These results show that if the moisture content of the sheet becomes high, the menthol flavor retention rate is suddenly decreased, and thus the sheet is preferably dried so that the moisture content of the sheet is less than 10%, preferably 9% or less. Particularly, it is found that even if the sheet after 2 months from preparation is further stored in the accelerated environments, it is possible to maintain a high menthol flavor retention rate by lowering the moisture content of the sheet to about 9% or less.

When the moisture content of the sheet is decreased to less than 3%, the menthol flavor retention rate is excellent. However, "cracking" or "peeling" occurs on the sheet in this case. Thus, the moisture content of the sheet after drying is preferably 3% or more.

Example 9

In this example, an effect of the type of polysaccharide on the post-storage menthol content of the menthol-containing sheets was examined. As the polysaccharide, carrageenan, gellan gum, pectin, and konjak glucomannan were used.

9-1. Method (Temperature-Responsive Sol-Gel Transition Characteristics)

In this experiment, temperature-responsive sol-gel transition characteristics of each aqueous polysaccharide solution were examined.

(1) Aqueous Carrageenan Solution

Water 0.1 L

κ-carrageenan (CARRAGEENAN CS-530/San-Ei Gen F.F.I., Inc.) 5 g (2) Aqueous Gellan Gum Solution As described in Example 4.

(3) Aqueous Pectin Solution

Water 0.1 L

Pectin (chemical use, derived from citrus, Wako Pure Chemical Industries, Ltd.) 3 g (4) Aqueous Konjak Glucomannan Solution Water 0.1 L Konjak glucomannan (Konjak raw material commerce & industry cooperative society in Gunma prefecture) 1 g The aqueous polysaccharide solution having the above composition was prepared in accordance with the procedure of Example 4.

The temperature of the aqueous polysaccharide solution was decreased to 25° C. for about 900 seconds. Thereafter, the temperature was raised for about 900 seconds. Changes in the viscosity (fluidity) of the aqueous polysaccharide solution followed by the fall and rise in temperature were measured with a rheometer (RheoStress 1, manufactured by Thermo-Haake). The results of the aqueous carrageenan solution are shown in FIGS. 7A and 7B, the results of the aqueous gellan gum solution are shown in FIGS. 2A and 2B, the results of the aqueous pectin solution are shown in FIGS. 7G and 7H, and the results of the aqueous konjak glucomannan solution are shown in FIGS. 7K and 7L.

9-2. Results (Temperature-Responsive Sol-Gel Transition Characteristics)

Figure 7A:
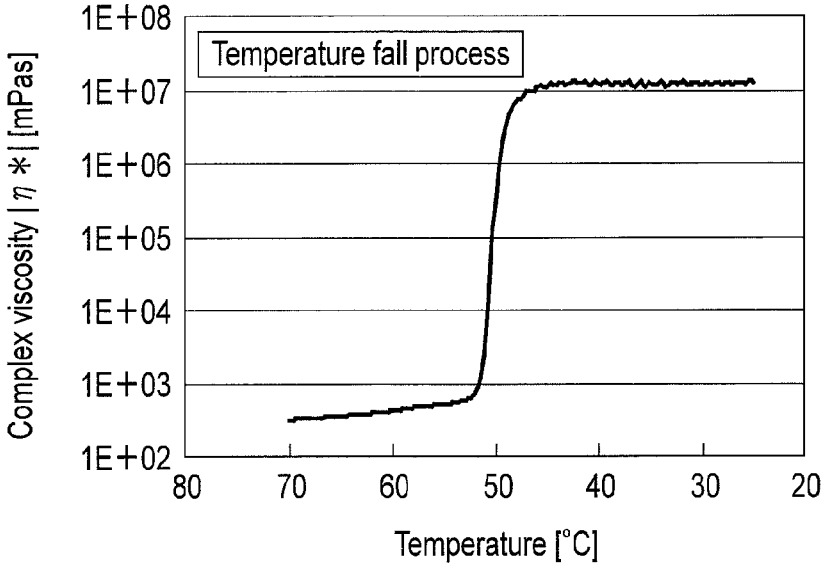
FIG. 7A is a graph showing changes in the viscosity followed by a fall in the temperature of aqueous carrageenan solution.
Figure 7B:
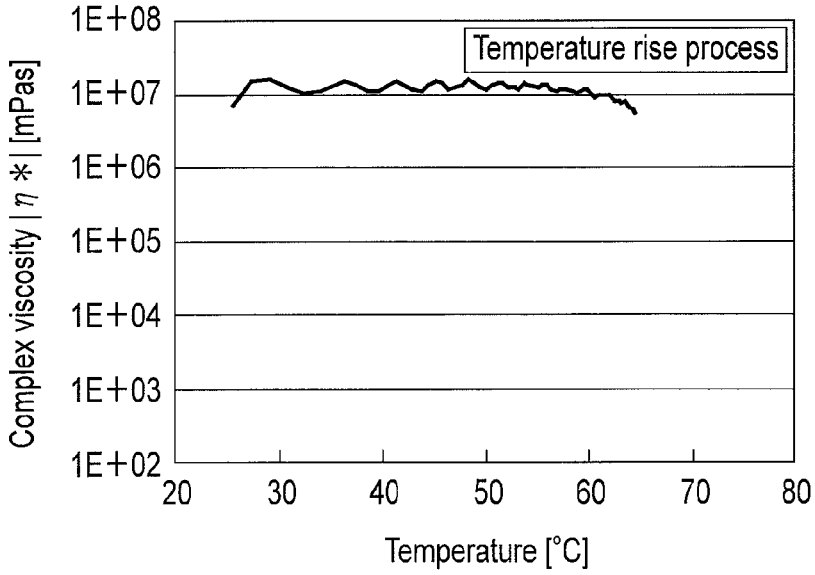
FIG. 7B is a graph showing changes in the viscosity followed by a rise in the temperature of aqueous carrageenan solution.

As shown in FIG. 7A, if the temperature of the aqueous carrageen solution was decreased to 25° C., the viscosity was low (about 1,000 mPas or less) up to a temperature of about 50° C. which was a sol-gel transition temperature. However, the viscosity was suddenly increased at a temperature lower than the transition temperature, and the viscosity reached 10,000,000 mPas (gelation). As shown in FIG. 7B, if the temperature of the obtained gel was raised, the gel did not easily return to a sol state even if it was heated at a temperature exceeding the transition temperature. Thus, the gel state could be maintained.

As shown in FIGS. 2A and 2B, once the aqueous gellan gum solution was cooled and formed gel, it was hard to return to a sol state even if it was heated at a temperature exceeding the transition temperature afterward. Thus, the gel state could be maintained (see Example 4).

As described above, the aqueous carrageenan solution and the aqueous gellan gum solution had "temperature-responsive sol-gel transition characteristics".

On the other hand, the aqueous pectin solution did not have "temperature-responsive sol-gel transition characteristics" as shown in FIGS. 7G and 7H.

Further, the aqueous konjak glucomannan solution did not have "temperature-responsive sol-gel transition characteristics" as shown in FIGS. 7K and 7L.

9-3. Method (Preparation of Sheet)

In this experiment, menthol-containing sheets were prepared using each of aqueous polysaccharide solutions, and the sample temperatures were measured during the heat-drying step.

The sheet preparation was performed in accordance with the same procedure as Example 1.

(1) Preparation of Carrageenan-Containing Sheet

Water 10 L

κ-carrageenan (CARRAGEENAN CS-530/San-Ei Gen F.F.I., Inc.) 500 g

5% aqueous lecithin solution (SUN LECITHIN A-1, Taiyo Kagaku Co., Ltd.) 200 mL

Menthol (Takasago International Corporation.) 2500 g 500 g (5 parts by weight) of κ-carrageenan was added to 10 L (100 parts by weight) of water (heated and kept at 80° C.) and dissolved therein in small portions so as not to form lumps (the time required: about 20 minutes), while stirring them with a mixer (PRIMIX T.K. AUTO MIXER Model 40/equipped with a rotor for stirring a solution/2000 rpm). 2500 g (25 parts by weight) of 1-menthol was added at the same temperature. The stirring mixer was replaced with a homogenizer (PRIMIX T.K. AUTO MIXER Model 40/equipped with a rotor-stator head/4000 rpm) and the mixture was emulsified for 10 minutes. Then, 200 ml (2 parts by weight) of 5% aqueous lecithin solution was added thereto, and they were stirred. Menthol was dispersed in the aqueous carrageenan solution.

The dispersed slurry was casted on the substrate (PET film, FE2001, FUTAMURA CHEMICAL CO., LTD.) so as to have a thickness of 1 mm (wet state). Thereafter, the slurry was cooled to about 20° C. using the cold air of about 10° C. generated by a spot cooler (Suiden SS-25DD-1).

Then, the cooled slurry was subjected to dry forming using a hot air drying machine in accordance with the same procedure as Example 1 so as to have a moisture content of about 6%, and thereby a carrageenan-containing sheet was prepared. The moisture content was measured by GC-TCD (see Example 1). The following hot air drying conditions were employed: at a hot air temperature of 110° C. for 3 minutes, at a hot air temperature of 100° C. for 6 minutes, and at a hot air temperature of 80° C. for 3 minutes (the total drying time: 12 minutes).

A control sheet (no cooling) was prepared by dry-forming the casted slurry without performing the cooling process. The hot air drying conditions of the control sheet were as follows: at a hot air temperature of 110° C. for 2.5 minutes, at a hot air temperature of 100° C. for 5 minutes, and at a hot air temperature of 80° C. for 2.5 minutes (the total drying time: 10 minutes).

Figure 7C:
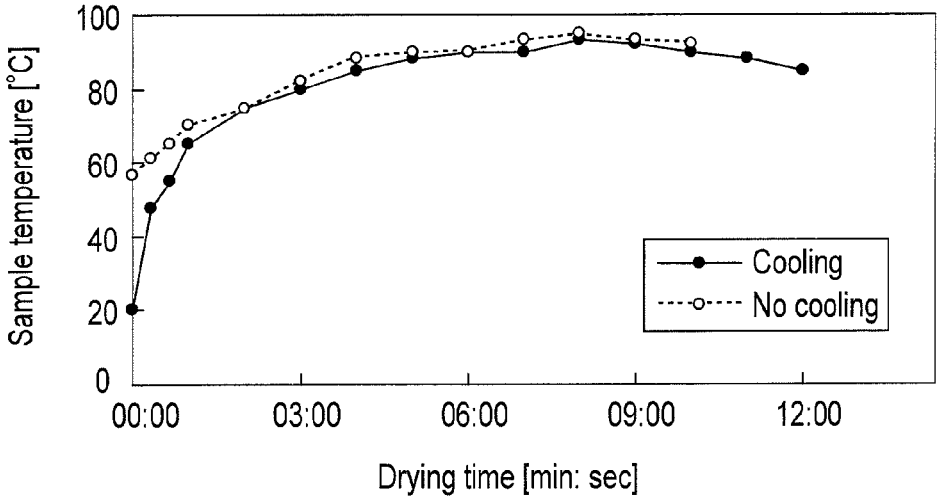
FIG. 7C is a graph showing the sample temperature during the heat-drying step of a raw material slurry containing carrageenan as a polysaccharide.

The measurement of the sample temperature was performed using a non-contact thermometer in a similar manner to that of Example 5. FIG. 7C shows changes in the sample temperature during the drying step. In FIG. 7C, "cooling" represents a sample which was cooled to about 20° C. by blowing cold air (10° C.) on it before the drying step, while "no cooling" represents a sample which was dried immediately after casting the slurry without performing the cooling process. FIG. 7C shows that the cooling of the slurry does not affect on the temperature of each sample during the drying step.

(2) Preparation of Gellan Gum-Containing Sheet

Water 10 L

Gellan gum (KELCOGEL, San-Ei Gen F.F.I., inc.) 300 g

5% aqueous lecithin solution (SUN LECITHIN A-1, Taiyo Kagaku Co., Ltd.) 120 mL

Menthol (Takasago International Corporation.) 1500 g 300 g (3 parts by weight) of gellan gum was added to 10 L (100 parts by weight) of water (heated and kept at 80° C.) and dissolved therein in small portions so as not to form lumps (the time required: about 20 minutes), while stirring them with a mixer (PRIMIX T.K. AUTO MIXER Model 40/equipped with a rotor for stirring a solution/2000 rpm). 1500 g (15 parts by weight) of 1-menthol was added at the same temperature. The stirring mixer was replaced with a homogenizer (PRIMIX T.K. Model 40/equipped with a rotor-stator head/4000 rpm) and the mixture was emulsified for 10 minutes. Then, 120 ml (1.2 parts by weight) of 5% aqueous lecithin solution was added thereto, and they were stirred. Menthol was dispersed in the aqueous gellan gum solution.

The dispersed slurry was casted on the substrate (PET film, FE2001, FUTAMURA CHEMICAL CO., LTD.) so as to have a thickness of 1 mm (wet state). Thereafter, the slurry was cooled to about 20° C. using the cold air of about 10° C. generated by a spot cooler (Suiden SS-25DD-1).

Then, the cooled slurry was subjected to dry forming using a hot air drying machine in accordance with the same procedure as Example 1 so as to have a moisture content of about 6%, and thereby a gellan gum-containing sheet was prepared. The moisture content was measured by GC-TCD (see Example 1). The following hot air drying conditions were employed: at a hot air temperature of 110° C. for 2.8 minutes, at a hot air temperature of 100° C. for 5.5 minutes, and at a hot air temperature of 80° C. for 2.8 minutes (the total drying time: about 11 minutes).

A control sheet (no cooling) was prepared by dry-forming the casted slurry without performing the cooling process. The hot air drying conditions of the control sheet were as follows: at a hot air temperature of 110° C. for 2.3 minutes, at a hot air temperature of 100° C. for 4.5 minutes, and at a hot air temperature of 80° C. for 2.3 minutes (the total drying time: about 9 minutes).

The measurement of the sample temperature was performed using a non-contact thermometer in a similar manner to that of Example 5. FIG. 7E shows changes in the sample temperature during the drying step. In FIG. 7E, "cooling" represents a sample which was cooled to about 20° C. by blowing cold air (10° C.) on it before the drying step, while "no cooling" represents a sample which was dried immediately after casting the slurry without performing the cooling process. FIG. 7E shows that the cooling of the slurry does not affect on the temperature of each sample during the drying step.

(3) Preparation of Pectin-Containing Sheet

Water 10 L

Pectin (chemical use, derived from citrus, Wako Pure Chemical Industries, Ltd.) 300 g 5% aqueous lecithin solution (SUN LECITHIN A-1, Taiyo Kagaku Co., Ltd.) 120 mL Menthol (Takasago International Corporation.) 1500 g 300 g (3 parts by weight) of pectin was added to 10 L (100 parts by weight) of water (heated and kept at 80° C.) and dissolved therein in small portions so as not to form lumps (the time required: about 20 minutes), while stirring them with a mixer (PRIMIX T.K. AUTO MIXER Model 40/equipped with a rotor for stirring a solution/2000 rpm). 1500 g (15 parts by weight) of 1-menthol was added at the same temperature. The stirring mixer was replaced with a homogenizer (PRIMIX T.K. AUTO MIXER Model 40/equipped with a rotor-stator head/4000 rpm) and the mixture was emulsified for 10 minutes. Then, 120 ml (1.2 parts by weight) of 5% aqueous lecithin solution was added thereto, and they were stirred. Menthol was dispersed in the aqueous pectin solution.

The dispersed slurry was casted on the substrate (PET film, FE2001, FUTAMURA CHEMICAL CO., LTD.) so as to have a thickness of 1 mm (wet state). Thereafter, the slurry was cooled to about 20° C. using the cold air of about 10° C. generated by a spot cooler (Suiden SS-25DD-1).

Then, the cooled slurry was subjected to dry forming using a hot air drying machine in accordance with the same procedure as Example 1 so as to have a moisture content of about 6%, and thereby a pectin-containing sheet was prepared. The moisture content was measured by GC-TCD (see Example 1). The following hot air drying conditions were employed: at a hot air temperature of 110° C. for 2.8 minutes, at a hot air temperature of 100° C. for 5.5 minutes, and at a hot air temperature of 80° C. for 2.8 minutes (the total drying time: about 11 minutes).

A control sheet (no cooling) was prepared by dry-forming the casted slurry without performing the cooling process. The hot air drying conditions of the control sheet were as follows: at a hot air temperature of 110° C. for 2.5 minutes, at a hot air temperature of 100° C. for 5 minutes, and at a hot air temperature of 80° C. for 2.5 minutes (the total drying time: 10 minutes).

The measurement of the sample temperature was performed using a non-contact thermometer in a similar manner to that of Example 5. FIG. 7I shows changes in the sample temperature during the drying step. In FIG. 7I, "cooling" represents a sample which was cooled to about 20° C. by blowing cold air (10° C.) on it before the drying step, while "no cooling" represents a sample which was dried immediately after casting the slurry without performing the cooling process. FIG. 7I shows that the cooling of the slurry does not affect on the temperature of each sample during the drying step.

(4) Preparation of Konjak Glucomannan-Containing Sheet

Water 10 L

Konjak glucomannan (Konjak raw material commerce & industry cooperative society in Gunma prefecture) 100 g 5% aqueous lecithin solution (SUN LECITHIN A-1, Taiyo Kagaku Co., Ltd.) 40 mL Menthol (Takasago International Corporation.) 500 g 100 g (1 part by weight) of konjak glucomannan was added to 10 L (100 parts by weight) of water (heated and kept at 80° C.) and dissolved therein in small portions so as not to form lumps (the time required: about 20 minutes), while stirring them with a mixer (PRIMIX T.K. AUTO MIXER Model 40/equipped with a rotor for stirring a solution). 500 g (5 parts by weight) of 1-menthol was added at the same temperature. The stirring mixer was replaced with a homogenizer (PRIMIX T.K. AUTO MIXER Model 40/equipped with a rotor-stator head) and the mixture was emulsified for 10 minutes. Then, 40 ml (0.4 part by weight) of 5% aqueous lecithin solution was added thereto, and they were stirred. Menthol was dispersed in the aqueous konjak glucomannan solution.

The dispersed slurry was casted on the substrate (PET film, FE2001, FUTAMURA CHEMICAL CO., LTD.) so as to have a thickness of 1 mm (wet state). Thereafter, the slurry was cooled to about 20° C. using the cold air of about 10° C. generated by a spot cooler (Suiden SS-25DD-1).

Then, the cooled slurry was subjected to dry forming using a hot air drying machine in accordance with the same procedure as Example 1 so as to have a moisture content of about 6%, and thereby a konjak glucomannan-containing sheet was prepared. The moisture content was measured by GC-TCD (see Example 1). The following hot air drying conditions were employed: at a hot air temperature of 110° C. for 3 minutes, at a hot air temperature of 100° C. for 6 minutes, and at a hot air temperature of 80° C. for 3 minutes (the total drying time: 12 minutes).

A control sheet (no cooling) was prepared by dry-forming the casted slurry without performing the cooling process. The hot air drying conditions of the control sheet were as follows: at a hot air temperature of 110° C. for 2.5 minutes, at a hot air temperature of 100° C. for 5 minutes, and at a hot air temperature of 80° C. for 2.5 minutes (the total drying time: 10 minutes).

The measurement of the sample temperature was performed using a non-contact thermometer in a similar manner to that of Example 5. FIG. 7M shows changes in the sample temperature during the drying step. In FIG. 7M, "cooling" represents a sample which was cooled to about 20° C. by blowing cold air (10° C.) on it before the drying step, while "no cooling" represents a sample which was dried immediately after casting the slurry without performing the cooling process. FIG. 7M shows that the cooling of the slurry does not affect on the temperature of each sample during the drying step.

9-4. Method (Measurement of Menthol Content)

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the carrageenan-containing sheet are shown in FIG. 7D, the results of the gellan gum-containing sheet are shown in FIG. 7F, the results of the pectin-containing sheet are shown in FIG. 7J, and the results of the konjak glucomannan-containing sheet are shown in FIG. 7N.

9-5. Results (Menthol Content)

Figure 7D:
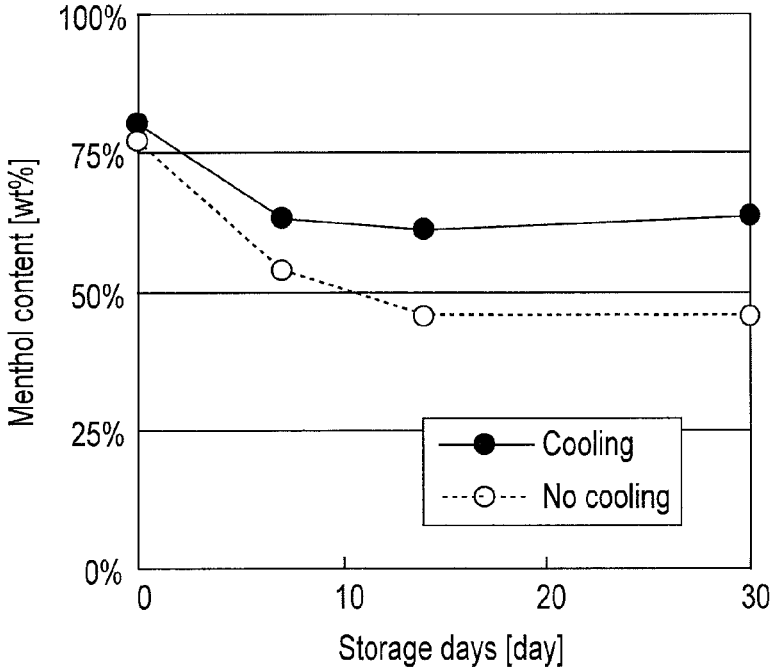
FIG. 7D is a graph showing the post-storage menthol content of menthol-containing sheets prepared using a raw material slurry containing carrageenan as a polysaccharide.
Figure 7E:
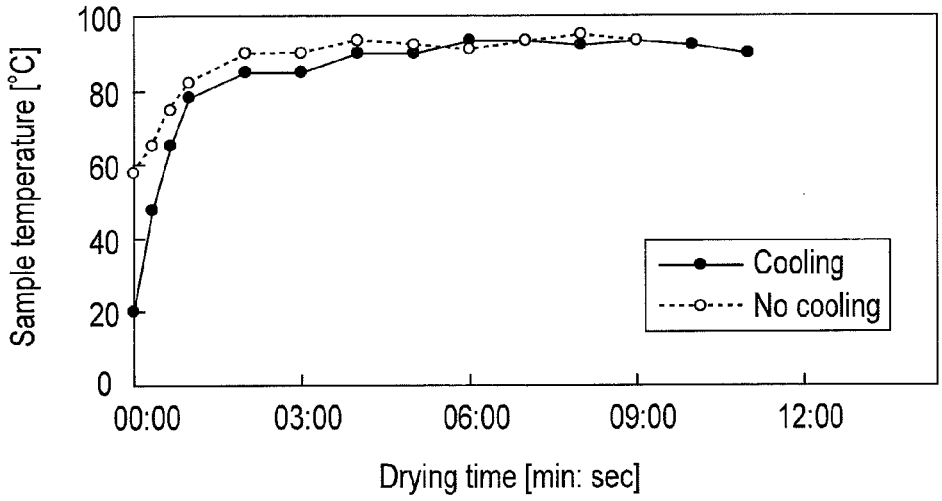
FIG. 7E is a graph showing the sample temperature during the heat-drying step of a raw material slurry containing gellan gum as a polysaccharide.

In the case of the carrageenan-containing sheet, as shown in FIG. 7D, when the slurry was cooled before the drying step, the initial menthol content was about 80 wt %, and the menthol content after storage for 30 days was 60 wt % or more (menthol flavor retention rate=about 80%). On the other hand, when the slurry was not cooled before the drying step, the initial menthol content was about 80 wt %, and the menthol content after storage for 30 days was about 45 wt % (menthol flavor retention rate=about 60%).

Figure 7F:
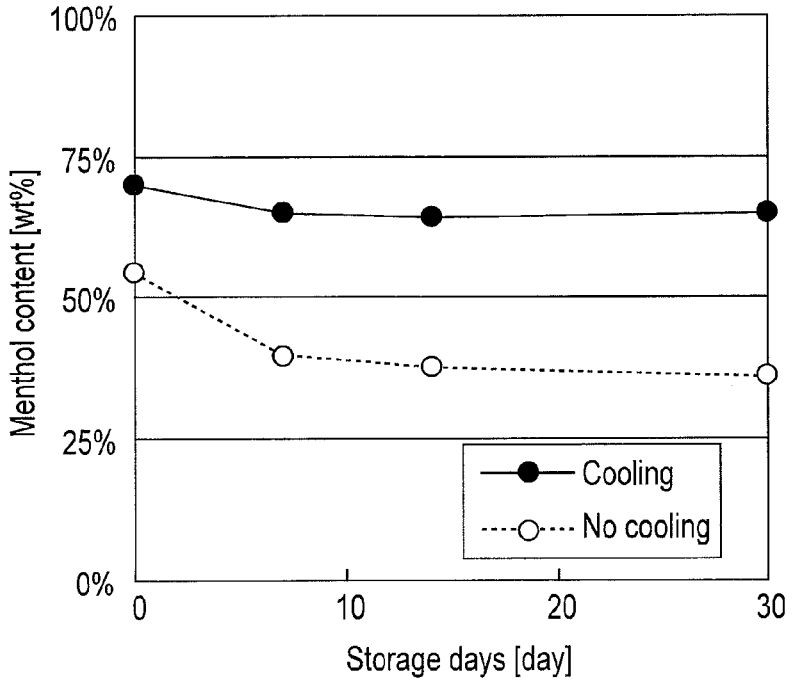
FIG. 7F is a graph showing the post-storage menthol content of menthol-containing sheets prepared using a raw material slurry containing gellan gum as a polysaccharide.
Figure 7G:
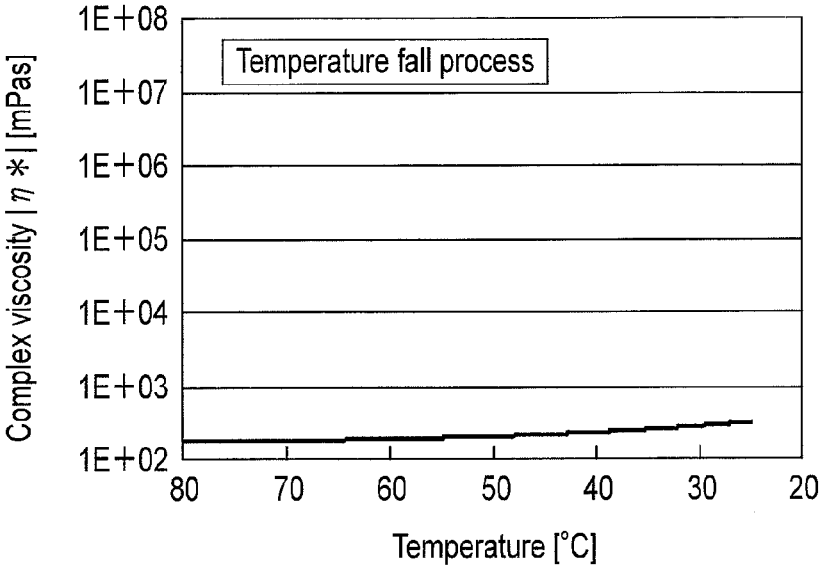
FIG. 7G is a graph showing changes in the viscosity followed by a fall in the temperature of aqueous pectin solution.
Figure 7H:
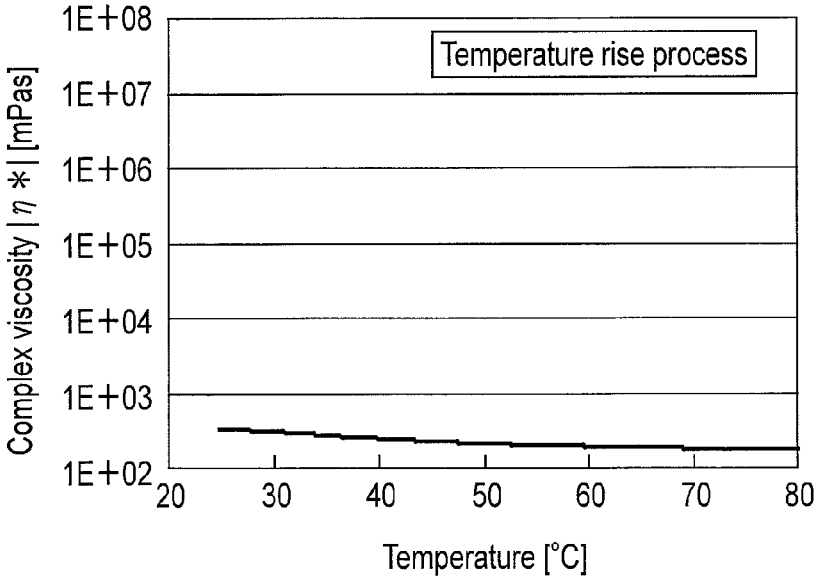
FIG. 7H is a graph showing changes in the viscosity followed by a rise in the temperature of aqueous pectin solution.
Figure 7I:
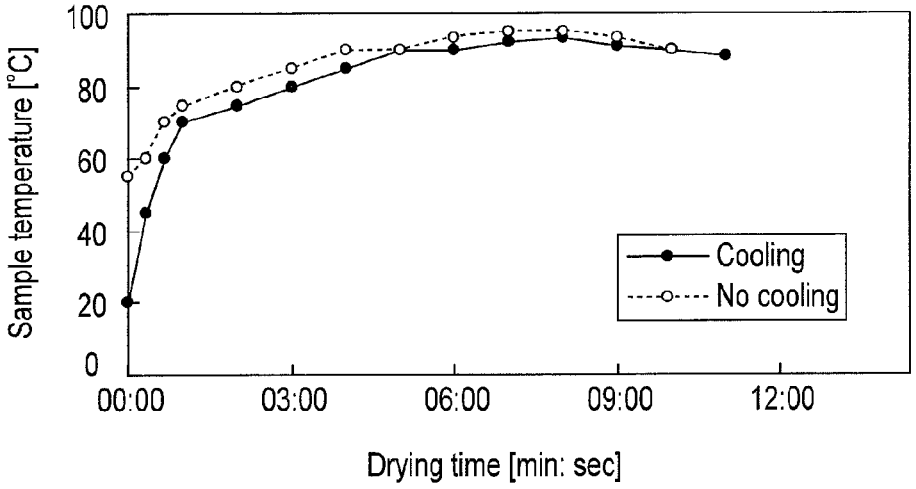
FIG. 7I is a graph showing the sample temperature during the heat-drying step of a raw material slurry containing pectin as a polysaccharide.
Figure 7J:
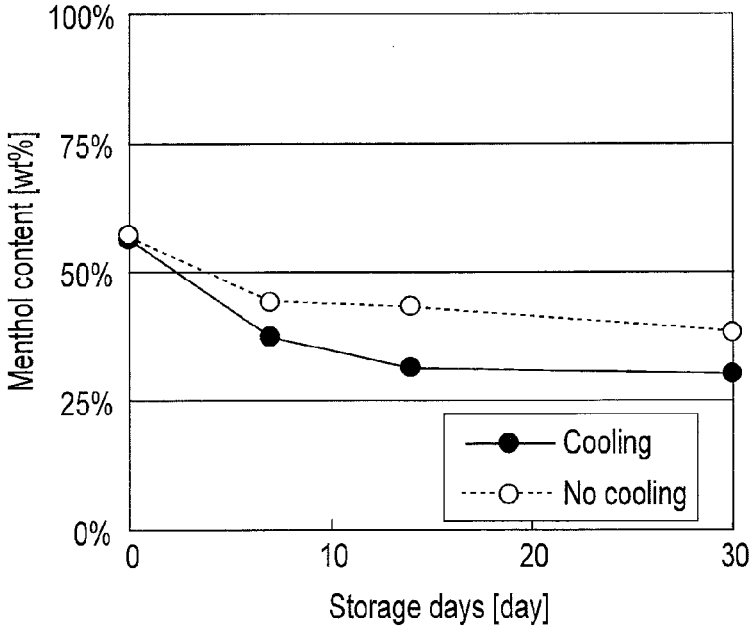
FIG. 7J is a graph showing the post-storage menthol content of menthol-containing sheets prepared using a raw material slurry containing pectin as a polysaccharide.
Figure 7K:
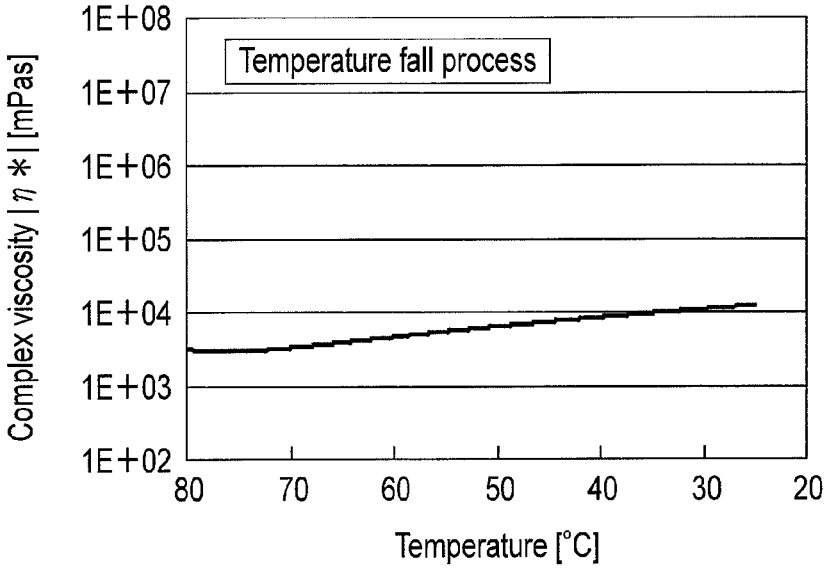
FIG. 7K is a graph showing changes in the viscosity followed by a fall in the temperature of aqueous konjak glucomannan solution.
Figure 7L:
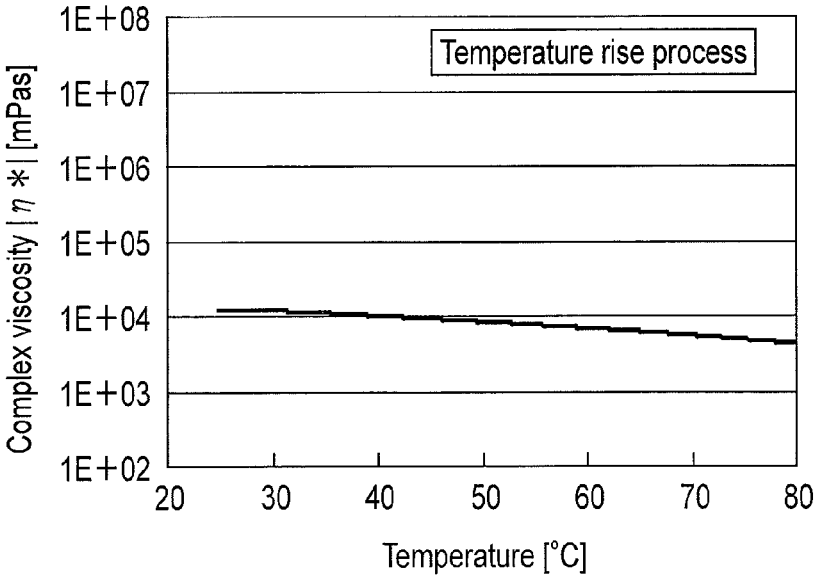
FIG. 7L is a graph showing changes in the viscosity followed by a rise in the temperature of aqueous konjak glucomannan solution.
Figure 7M:
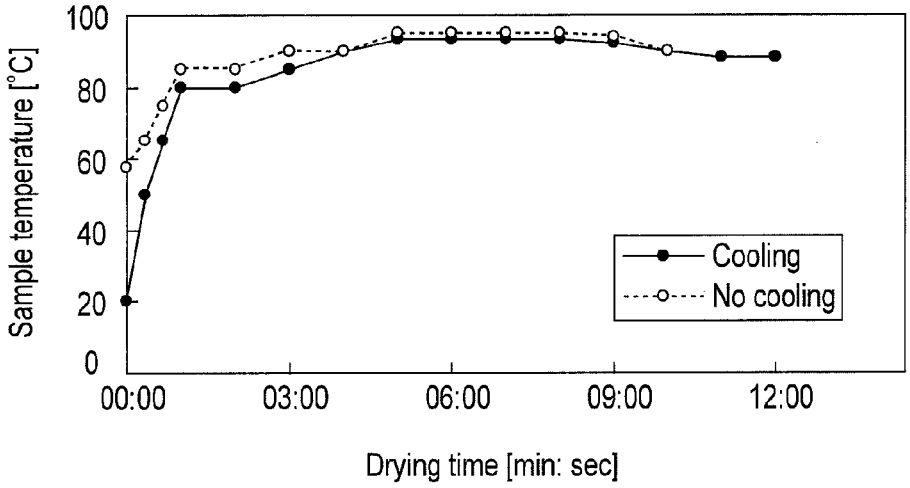
FIG. 7M is a graph showing the sample temperature during the heat-drying step of a raw material slurry containing konjak glucomannan as a polysaccharide.
Figure 7N:
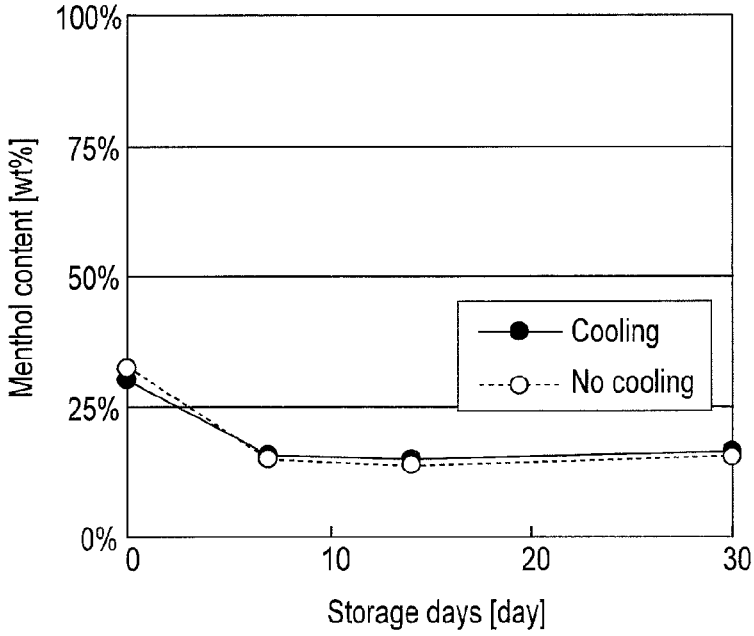
FIG. 7N is a graph showing the post-storage menthol content of menthol-containing sheets prepared using a raw material slurry containing konjak glucomannan as a polysaccharide.

In the case of the gellan gum-containing sheet, as shown in FIG. 7F, when the slurry was cooled before the drying step, the initial menthol content was about 70 wt %, and the menthol content after storage for days was about 65 wt % (menthol flavor retention rate=about 90% or more). On the other hand, when the slurry was not cooled before the drying step, the initial menthol content was about 55 wt %, and the menthol content after storage for 30 days was about wt % (menthol flavor retention rate=about 65%).

In the case of the pectin-containing sheet, as shown in FIG. 7J, regardless of whether the slurry was cooled before the drying step or not, the initial menthol content was about 60 wt %, and the menthol content after storage for 30 days was about 30 wt % (menthol flavor retention rate=about 55% to about 65%).

In the case of the konjak glucomannan-containing sheet, as shown in FIG. 7N, regardless of whether the slurry was cooled before the drying step or not, the initial menthol content was about 30 wt %, and the menthol content after storage for 30 days was about 15 wt % (menthol flavor retention rate=about 50%).

The above results show that when carrageenan or gellan gum is used as the polysaccharide, and the slurry is once cooled before the drying step and then dried, the obtained sheet has a high menthol content and a high yield of menthol, and also maintains a high menthol content after storage.

Therefore, in the following examples, carrageenan or gellan gum was used as the polysaccharide, and the slurry was once cooled before the drying step and then dried.

Example 10

In this example, an effect of the concentration of polysaccharide on the post-storage menthol content of the menthol-containing sheets was examined.

10-1. Method (Temperature-Responsive Sol-Gel Transition Characteristics)

In this experiment, temperature-responsive sol-gel transition characteristics of raw material slurries (sheet preparation solution) containing polysaccharide at various concentrations were examined. As the polysaccharide, 1 part by weight (1%), 2 parts by weight (2%), 3 parts by weight (3%), 5 parts by weight (5%), and 7 parts by weight (7%) of carrageenan were used based on water (100 parts by weight). Further, 1 part by weight (1%), 2 parts by weight (2%), 3 parts by weight (3%), 5 parts by weight (5%), and 7 parts by weight (7%) of gellan gum were used based on water (100 parts by weight). In the following description and FIGS. 8A to 8F, the concentration of polysaccharide is represented by weight percentage (%) based on water.

Raw material slurries containing carrageenan and raw material slurries containing gellan gum were prepared according to the description of the column 9-3 of Example 9. Depending on the concentrations of polysaccharide, menthol was added in an amount 5 times as much as polysaccharide (weight ratio), and the 5% aqueous lecithin solution was added in an amount two-fifths times as much as polysaccharide (weight ratio).

The temperature of the raw material slurries containing polysaccharides at various concentrations was decreased from 70° C. to 25° C. for about 900 seconds. Thereafter, the temperature was raised to 70° C. for about 900 seconds. Changes in the viscosity (fluidity) of the slurries followed by the fall and rise in temperature were measured with a rheometer (RheoStress 1, manufactured by Thermo-Haake). The results of the carrageenan-containing slurry are shown in FIGS. 8A and 8B, and the results of the gellan gum-containing slurry are shown in FIGS. 8D and 8E.

10-2. Results (Temperature-Responsive Sol-Gel Transition Characteristics)

Figure 8A:
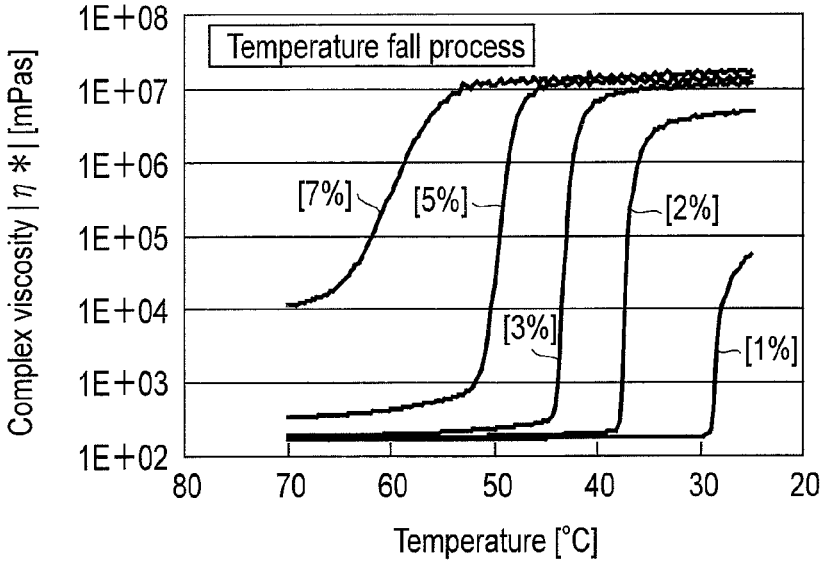
FIG. 8A is a graph showing changes in the viscosity followed by a fall in the temperature of aqueous carrageenan solution having various concentration.
Figure 8B:
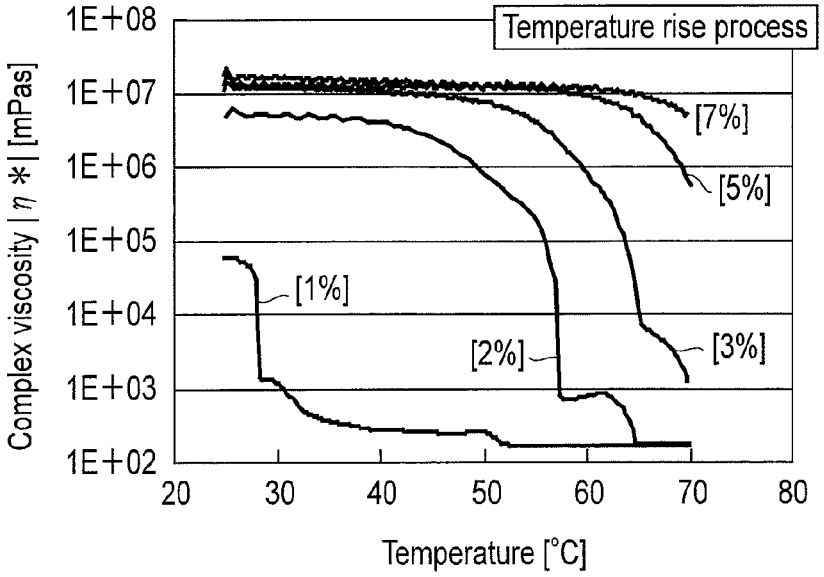
FIG. 8B is a graph showing changes in the viscosity followed by a rise in the temperature of aqueous carrageenan solution having various concentration.

As shown in FIGS. 8A and 8B, in the case of the raw material slurry containing 1 wt % of carrageenan, even if the slurry was cooled to 25° C., it was not sufficiently gelatinized. When the temperature of this raw material was increased afterward, it was difficult to maintain the gel state. In the case of the raw material slurry containing 7 wt % of carrageenan, the viscosity increased at an early stage in the temperature fall process (from 70 to 60° C.), and it was difficult to maintain the sol state. Accordingly, it was difficult to disperse menthol at the time of preparation of this raw material slurry.

Therefore, it is preferable that carrageenan is contained in the raw material slurry at a concentration of 2 to 5 wt %.

As shown in FIGS. 8D and 8E, in the case of the raw material slurry containing 1 wt % of gellan gum, even if the slurry was cooled to 25° C., it was not sufficiently gelatinized. When the temperature of this raw material was increased afterward, it was difficult to maintain the gel state. In the case of the raw material slurry containing 7 wt % of gellan gum, the viscosity increased at an early stage in the temperature fall process (from 70 to 60° C.), and it was difficult to maintain the sol state. Accordingly, it was difficult to disperse menthol at the time of preparation of this raw material slurry.

Therefore, it is preferable that gellan gum is contained in the raw material slurry at a concentration of 2 to 5 wt %.

10-3. Method (Preparation of Sheet and Measurement Of Menthol Content)

Carrageenan-containing sheets and gellan gum-containing sheets were prepared using raw material slurries containing polysaccharides at various concentrations (see the column 10-1). The sheet preparation was performed in accordance with the same procedure as Example 9.

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the carrageenan-containing sheet are shown in FIG. 8C, and the results of the gellan gum-containing sheet are shown in FIG. 8F.

10-4. Results (Menthol Content)

Figure 8C:
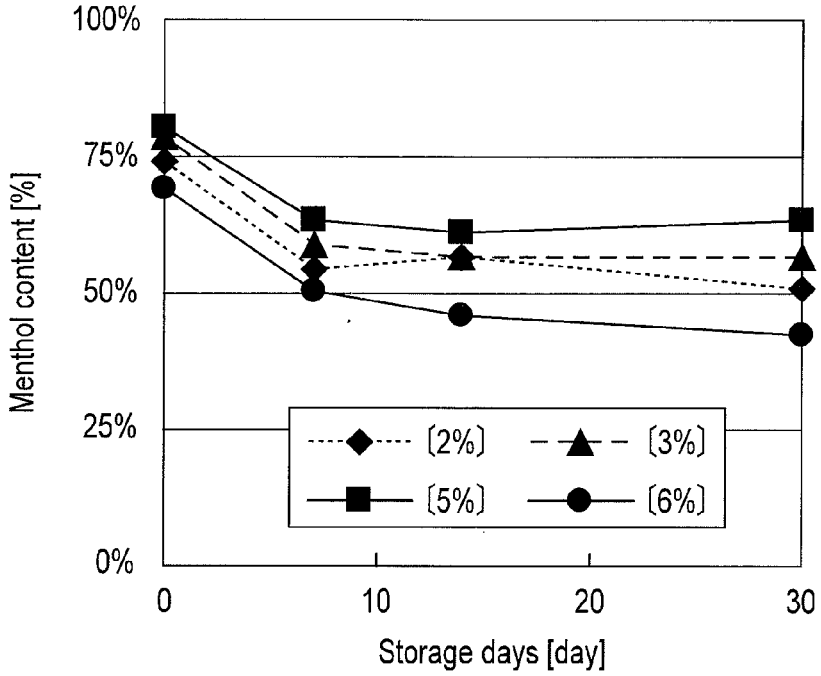
FIG. 8C is a graph showing the post-storage menthol content of menthol-containing sheets prepared using raw material slurries containing carrageenan at various concentration.
Figure 8D:
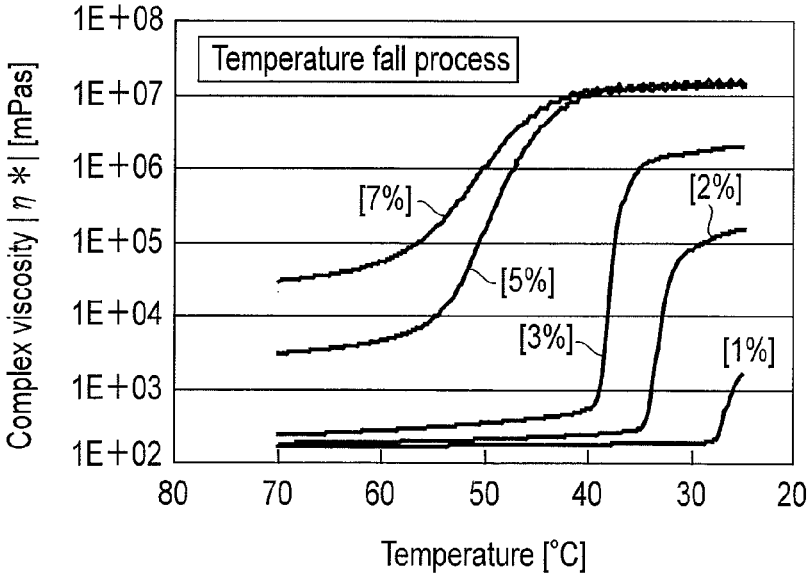
FIG. 8D is a graph showing changes in the viscosity followed by a fall in the temperature of aqueous gellan gum solution having various concentration.
Figure 8E:
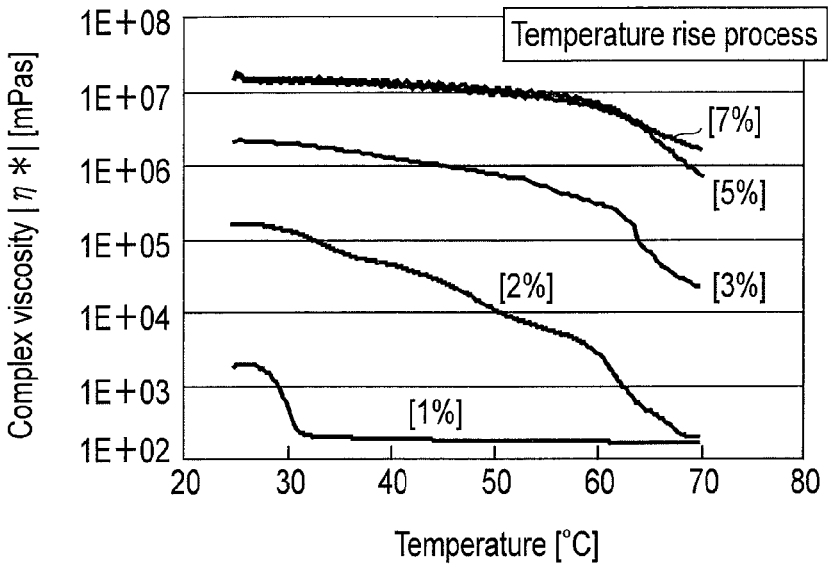
FIG. 8E is a graph showing changes in the viscosity followed by a rise in the temperature of aqueous gellan gum solution having various concentration.

In either case of the 3 wt % or 5 wt % carrageenan-containing sheet, as shown in FIG. 8C, the initial menthol content was about 80 wt %, and the menthol content after storage for 30 days was about 60 wt % (menthol flavor retention rate=about 80%). In the case of 2 wt % carrageenan, the initial menthol content was 74 wt %, and the menthol content after storage for 30 days exceeded 50 wt % (menthol flavor retention rate=68%). In the case of 6 wt % carrageenan, the initial menthol content was 69 wt %, and the menthol content after storage for 30 days was 43 wt % (menthol flavor retention rate=62%).

Figure 8F:
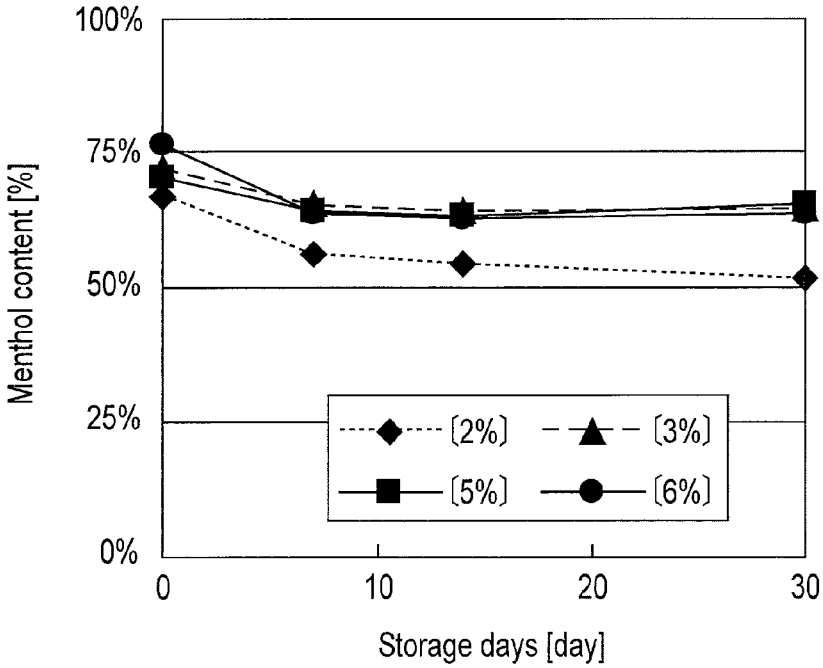
FIG. 8F is a graph showing the post-storage menthol content of menthol-containing sheets prepared using raw material slurries containing gellan gum at various concentration.

In either case of the 3 wt % or 5 wt % gellan gum-containing sheet, as shown in FIG. 8F, the initial menthol content was about 70 wt %, and the menthol content after storage for 30 days was close to 70 wt % (menthol flavor retention rate=about 90%). In the case of 2 wt % gellan gum, the initial menthol content was about 70 wt %, and the menthol content after storage for 30 days exceeded 50 wt % (menthol flavor retention rate=78%). In the case of 6 wt % gellan gum, the initial menthol content was 76 wt %, and the menthol content after storage for 30 days was 63 wt % (menthol flavor retention rate=83%).

These results show that carrageenan or gellan gum is contained in the raw material slurry at a concentration of preferably 2 to 6 wt %, more preferably 3 to 5 wt %.

Example 11

In this example, an effect of the blending ratio of menthol contained in the raw material slurry on the post-storage menthol content and the menthol yield of the menthol-containing sheets was examined.

11-1. Method (Preparation of Sheet and Measurement of Menthol Content)

Carrageenan-containing sheets and gellan gum-containing sheets were prepared using raw material slurries having various blending ratios of menthol. The sheet preparation was performed in accordance with the same procedure as Example 9.

Regarding the carrageenan-containing sheets, menthol was added in an amount equivalent to 1, 2.5, 5, 10, 15, and 20 times the weight of 5 wt % carrageenan (in the raw material slurry). Regarding the gellan gum-containing sheets, menthol was added in an amount equivalent to 0.5, 1, 2.5, 5, 10, 15, and 20 times the weight of 3 wt % gellan gum (in the raw material slurry).

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the carrageenan-containing sheet are shown in FIGS. 9A to 9E, and the results of the gellan gum-containing sheet are shown in FIGS. 9F to 9J. In these drawings, the expression [1:x] represents weight ratios of polysaccharide and menthol in the raw material slurry. For example, the expression [1:5] represents that menthol is contained in the raw material slurry in an amount equivalent to 5 times the weight of polysaccharide. In these drawings, the term "immediately after preparation" means a sheet immediately after the preparation, and the term "after 50° C.·1 month" means a sheet after storage at 50° C. for 30 days.

11-2. Results (1) Carrageenan-Containing Sheet

Figure 9A:
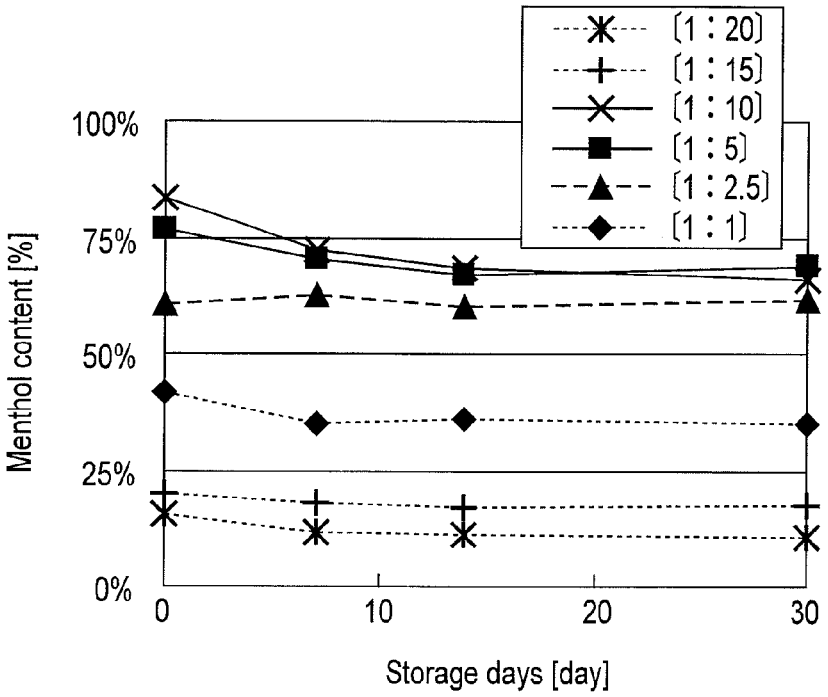
FIG. 9A is a graph showing the post-storage menthol content of menthol-containing sheets prepared using raw material slurries containing carrageenan and menthol at various ratios.
Figure 9B:
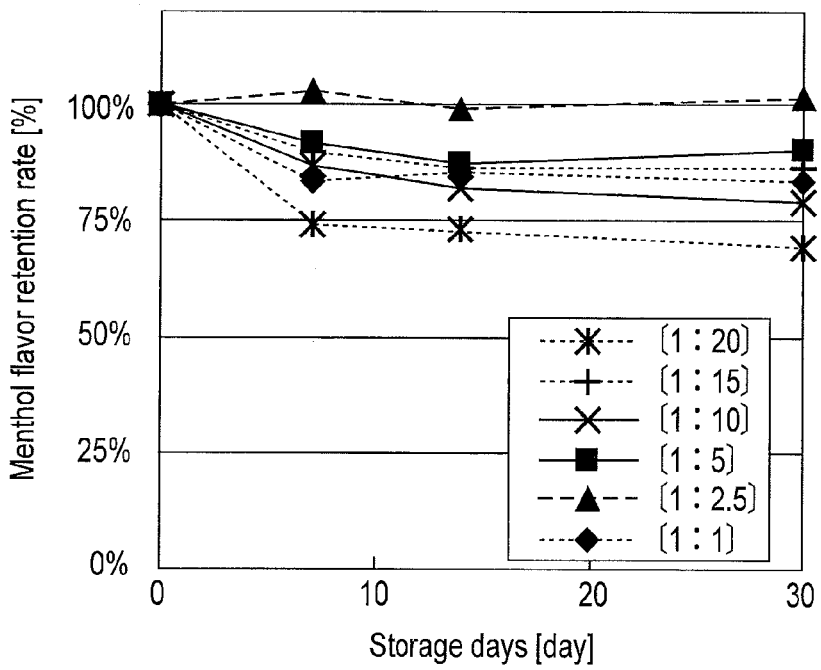
FIG. 9B is a graph showing the menthol flavor retention rates of menthol-containing sheets prepared using raw material slurries containing carrageenan and menthol at various ratios.

Regarding the carrageenan-containing sheets, as shown in FIG. 9A, the "initial menthol content" was the highest in the case of the sheet containing menthol in 10-fold weight, the second-highest in the case of the sheet containing menthol in 5-fold weight, the third-highest in the case of the sheet containing menthol in 2.5-fold weight, and the fourth-highest in the case of the sheet containing menthol in 1-fold weight. These results showed that the initial menthol content was dependent on the blending amount of menthol. On the other hand, in the cases of the sheets containing menthol in 15-fold and 20-fold weight, the "initial menthol content" was as low as 20 wt % or less. In all cases of the blending amounts of menthol, the "post-storage menthol content" was hardly reduced from the initial menthol content. Thus, as shown in FIG. 9B, the menthol flavor retention rate after storage for 30 days exceeded 70% in all cases of the blending amounts of menthol. Among them, the sheet containing menthol in 2.5-fold weight exhibited a menthol flavor retention rate of about 100%.

The ratio of the menthol content in the sheet to the amount of the menthol added in the raw material slurry was calculated as the "menthol yield (%)" using Equation below.

$$\text{Menthol yield (\%)}=\{(\text{measured value of menthol content in sheet})/(\text{blending amount of menthol})\}\times 100$$

Figure 9C:
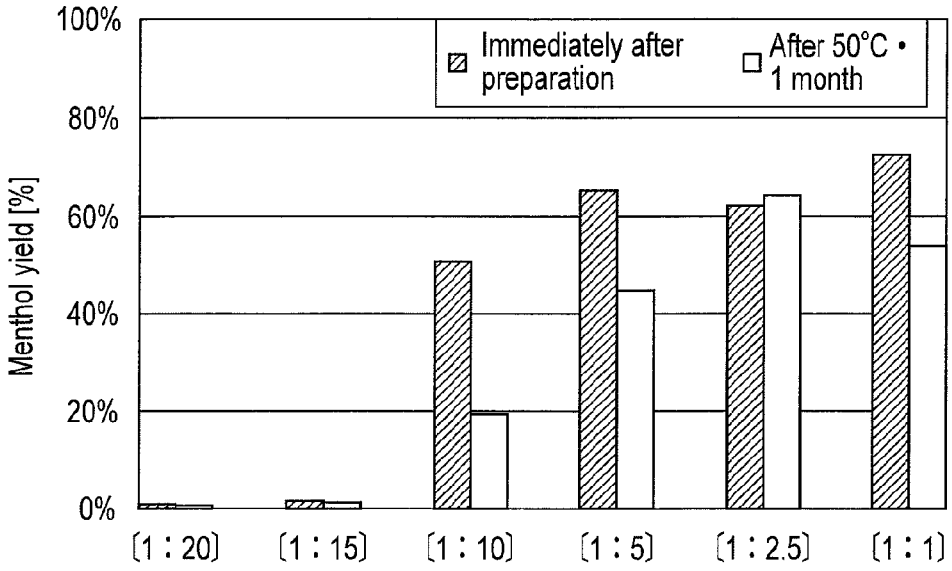
FIG. 9C is a graph showing the menthol yields of menthol-containing sheets prepared using raw material slurries containing carrageenan and menthol at various ratios.

As shown in FIG. 9C, the "menthol yield" immediately after the sheet preparation showed a value exceeding 50% in all cases of the samples in which the blending amount of menthol was 1 to 10-fold weight. The "menthol yield" after storage showed the highest value in the case of the sheet containing menthol in 2.5-fold weight. The sheet containing menthol in 5-fold or 10-fold weight showed a lower "menthol yield" after storage than that of the sheet containing menthol in 2.5-fold weight, but the menthol content in the sheet (absolute amount) is higher (see FIG. 9A).

Figure 9D:
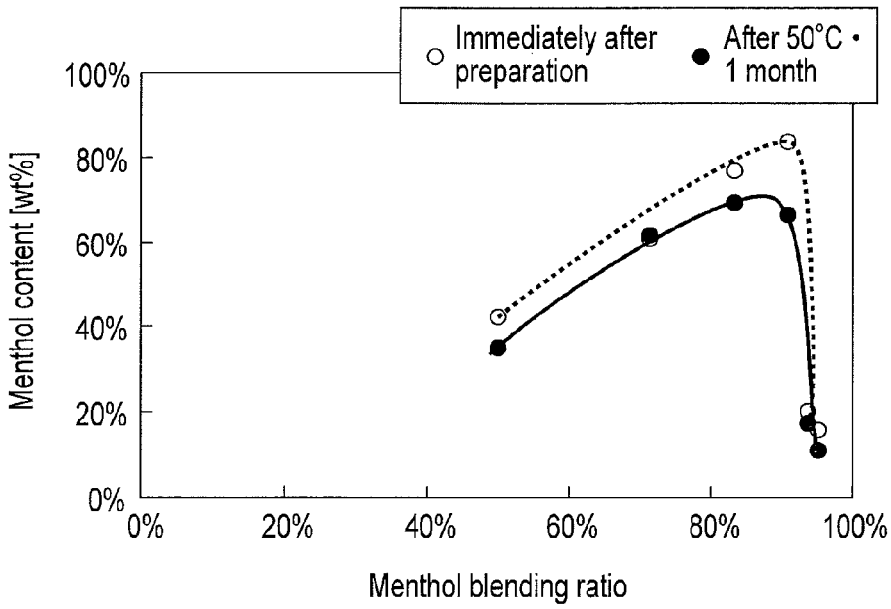
FIG. 9D is a graph showing a relationship between the blending ratio of menthol and the menthol content of the menthol-containing sheets (the case where the polysaccharide is carrageenan).
Figure 9E:
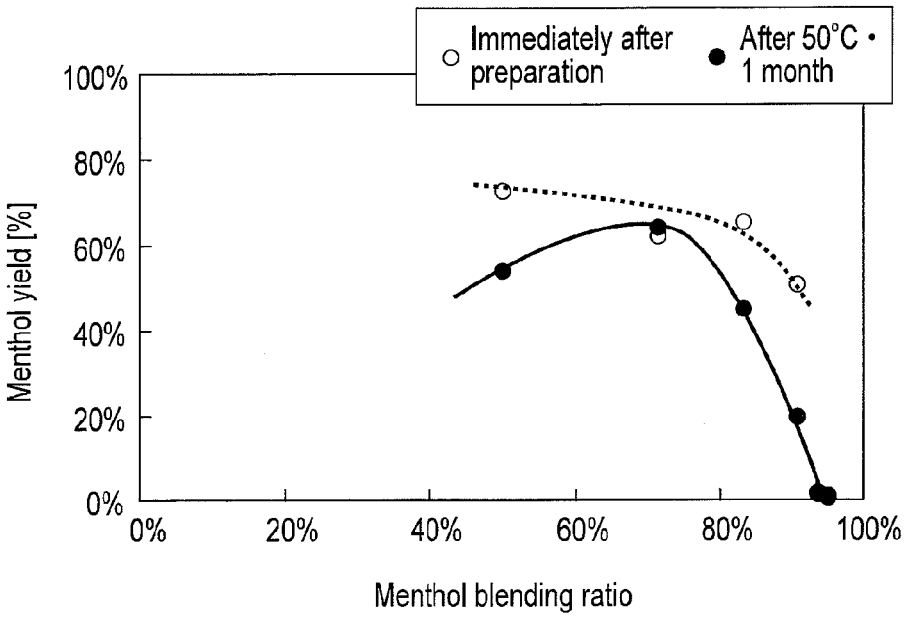
FIG. 9E is a graph showing a relationship between the blending ratio of menthol and the menthol yield of the menthol-containing sheets (the case where the polysaccharide is carrageenan).

FIGS. 9D and 9E show a relationship between the blending ratio (%) of menthol and the menthol content (%) and a relationship between the blending ratio (%) of menthol and the menthol yield (%), respectively. In these drawings, the blending ratio of menthol (%) is represented by the formula: {blending amount of menthol/(blending amount of menthol+blending amount of carrageenan)}×100.

As shown in FIG. 9D, the sheets in which the blending amount of menthol was 2.5 to 10-fold weight (i.e., the blending ratio of menthol is 71 to 91%) showed a high menthol content after storage. As shown in FIG. 9E, the sheets in which the blending amount of menthol was 1 to 5-fold weight (i.e., the blending ratio of menthol is 50 to 83%) showed a high menthol yield after storage.

The results of FIGS. 9A to 9E show that the blending amount of menthol to carrageenan is preferably 1 to 10-fold weight, more preferably 2.5 to 5-fold weight.

(2) Gellan Gum-Containing Sheet

Figure 9F:
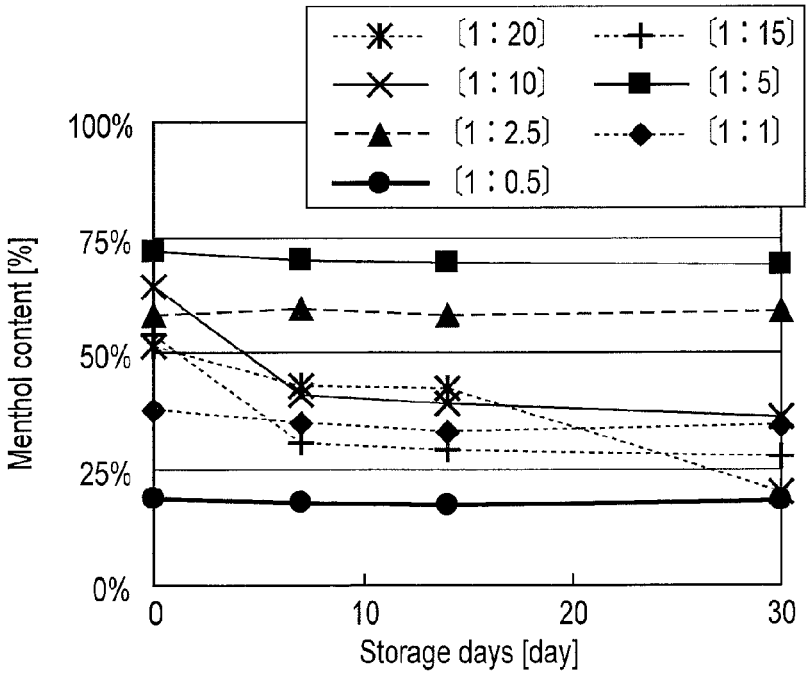
FIG. 9F is a graph showing the post-storage menthol content of menthol-containing sheets prepared using raw material slurries containing gellan gum and menthol at various ratios.
Figure 9G:
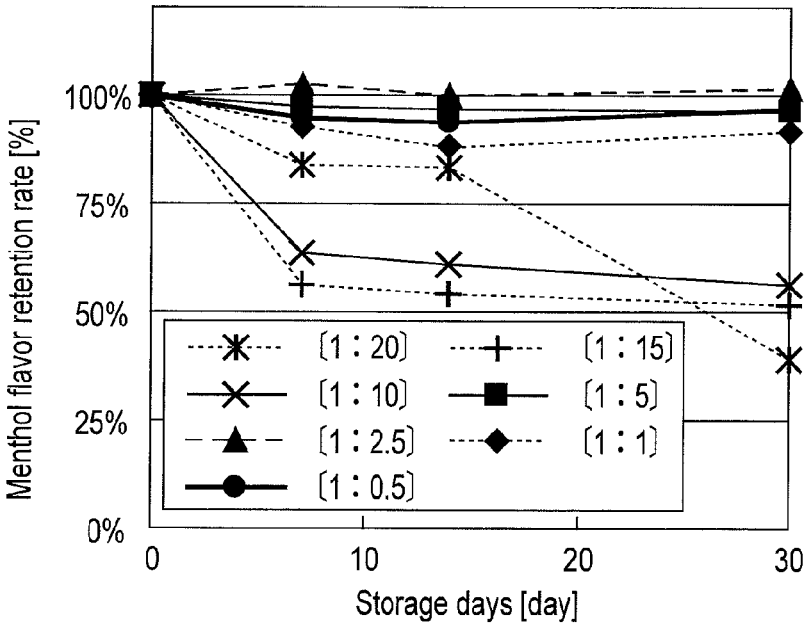
FIG. 9G is a graph showing the menthol flavor retention rates of menthol-containing sheets prepared using raw material slurries containing gellan gum and menthol at various ratios.

Regarding the gellan gum-containing sheets, as shown in FIG. 9F, the "initial menthol content" was the highest in the case of the sheet containing menthol in 5-fold weight, the lowest in the case of the sheet containing menthol in 0.5-fold weight, and dependent on the blending amount of menthol in the sheets in which the blending amount of menthol was 0.5 to 5-fold weight. In the samples in which the blending amount of menthol was 0.5 to 5-fold weight, the "post-storage menthol content" was hardly reduced from the initial menthol content. However, in the sheets in which the blending amount of menthol was 10-fold or more weight, the menthol content was reduced in the course of storage days. Thus, as shown in FIG. 9G, the menthol flavor retention rate after storage for 30 days exceeded 90% in the sheets in which the blending amount of menthol was 0.5 to 5-fold weight. However, the menthol flavor retention rate was about 50% in the sheets in which the blending amount of menthol was 10-fold or more weight. As described above, the sheets in which the blending amount of menthol was 0.5 to 5-fold weight had a high menthol flavor retention rate. Among them, the sheet containing menthol in 2.5-fold weight exhibited a menthol flavor retention rate of about 100%.

Figure 9H:
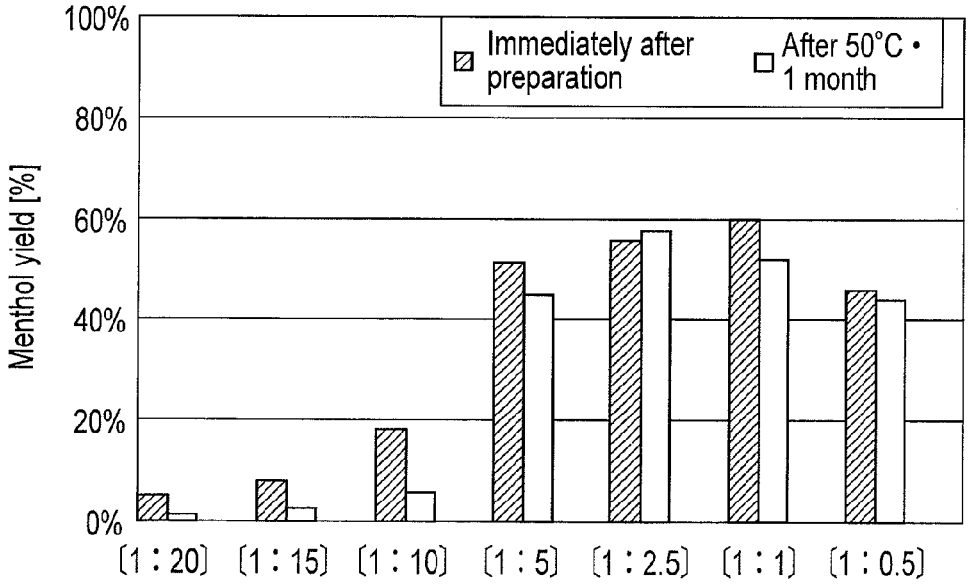
FIG. 9H is a graph showing the menthol yields of menthol-containing sheets prepared using raw material slurries containing gellan gum and menthol at various ratios.

As shown in FIG. 9H, the "menthol yield" immediately after the sheet preparation showed a value exceeding 50% in the cases of the sheets containing menthol in 1-, 2.5-, and 5-fold weight. The "menthol yield" after storage showed the highest value in the case of the sheet containing menthol in 2.5-fold weight. The sheet containing menthol in 5-fold weight showed a lower "menthol yield" after storage than that of the sheet containing menthol in 2.5-fold weight, but the menthol content in the sheet (absolute amount) is higher (see FIG. 9F).

Figure 9I:
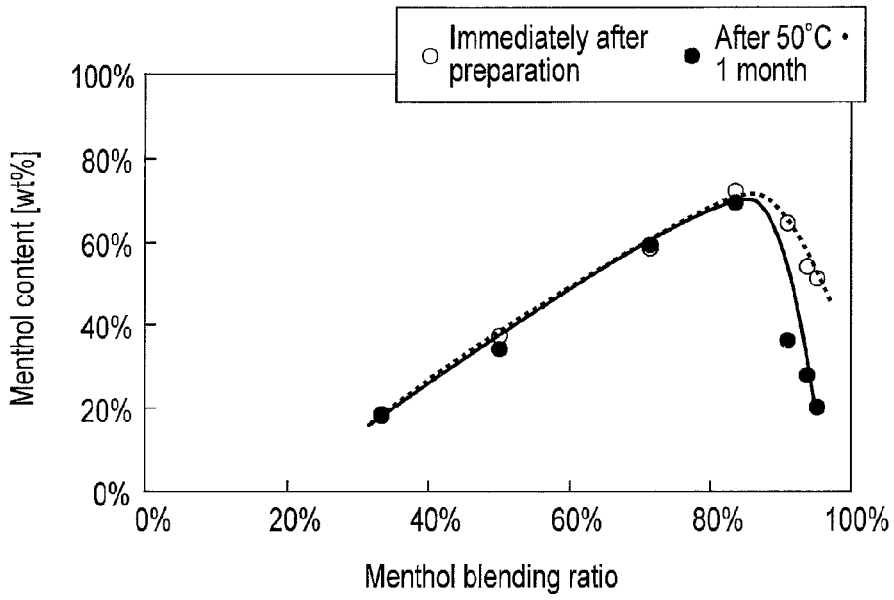
FIG. 9I is a graph showing a relationship between the blending ratio of menthol and the menthol content of the menthol-containing sheets (the case where the polysaccharide is gellan gum).
Figure 9J:
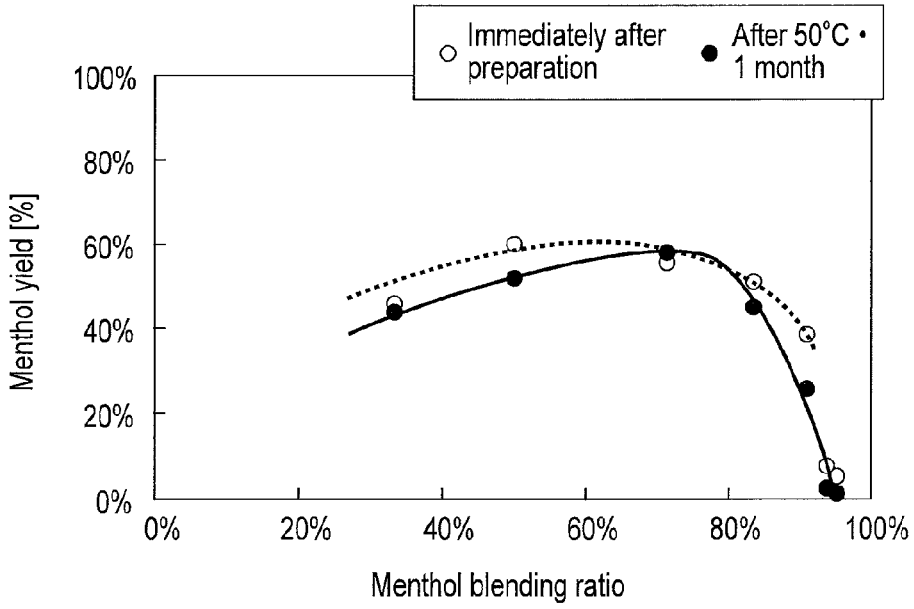
FIG. 9J is a graph showing a relationship between the blending ratio of menthol and the menthol yield of the menthol-containing sheets (the case where the polysaccharide is gellan gum).

FIGS. 9I and 9J show a relationship between the blending ratio (%) of menthol and the menthol content (%) and a relationship between the blending ratio (%) of menthol and the menthol yield (%), respectively. In the drawings, the blending ratio of menthol (%) is represented by the formula: {blending amount of menthol/(blending amount of menthol+blending amount of gellan gum)}×100.

As shown in FIG. 9I, the sheets in which the blending amount of menthol was 2.5 to 5-fold weight (i.e., the blending ratio of menthol is 71 to 83%) showed a high menthol content after storage. As shown in FIG. 9J, the sheets in which the blending amount of menthol was 1 to 5-fold weight (i.e., the blending ratio of menthol is 50 to 83%) showed a high menthol yield after storage.

The results of FIGS. 9F to 9J show that the blending amount of menthol to gellan gum is preferably 1 to 10-fold weight, more preferably 2.5 to 5-fold weight.

Example 12

In this example, an effect of the blending amount of lecithin contained in the raw material slurry on the post-storage menthol content of the menthol-containing sheets was examined.

12-1. Method (Preparation of Sheet and Measurement of Menthol Content)

Carrageenan-containing sheets and gellan gum-containing sheets were prepared using raw material slurries having various blending ratios of lecithin. The sheet preparation was performed in accordance with the same procedure as Example 9.

Regarding the carrageenan-containing sheets, lecithin was added in an amount equivalent to 0.001, 0.005, 0.01, 0.02, 0.05, 0.1, 0.2, and 0.4 times the weight of 5 wt % carrageenan (in the raw material slurry). Menthol was added in an amount equivalent to 5 times the weight of carrageenan.

Similarly, regarding the gellan gum-containing sheets, menthol was added in an amount equivalent to 0.001, 0.005, 0.01, 0.02, 0.05, 0.1, 0.2, and 0.4 times the weight of 3 wt % gellan gum (in the raw material slurry). Menthol was added in an amount equivalent to 5 times the weight of gellan gum.

Figure 10A:
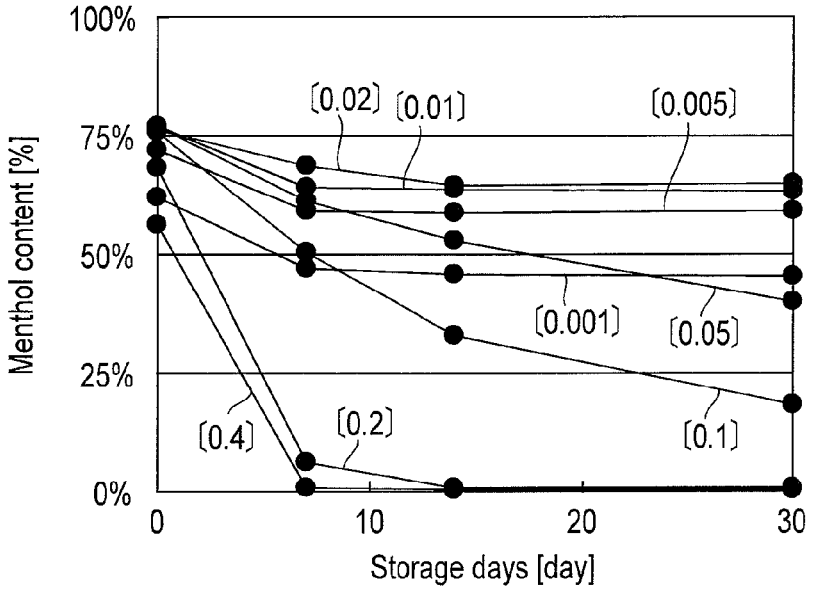
FIG. 10A is a graph showing the post-storage menthol content of menthol-containing sheets prepared using raw material slurries containing lecithin in various blending amounts (weight ratio based on the polysaccharide) (the case where the polysaccharide is carrageenan).
Figure 10B:
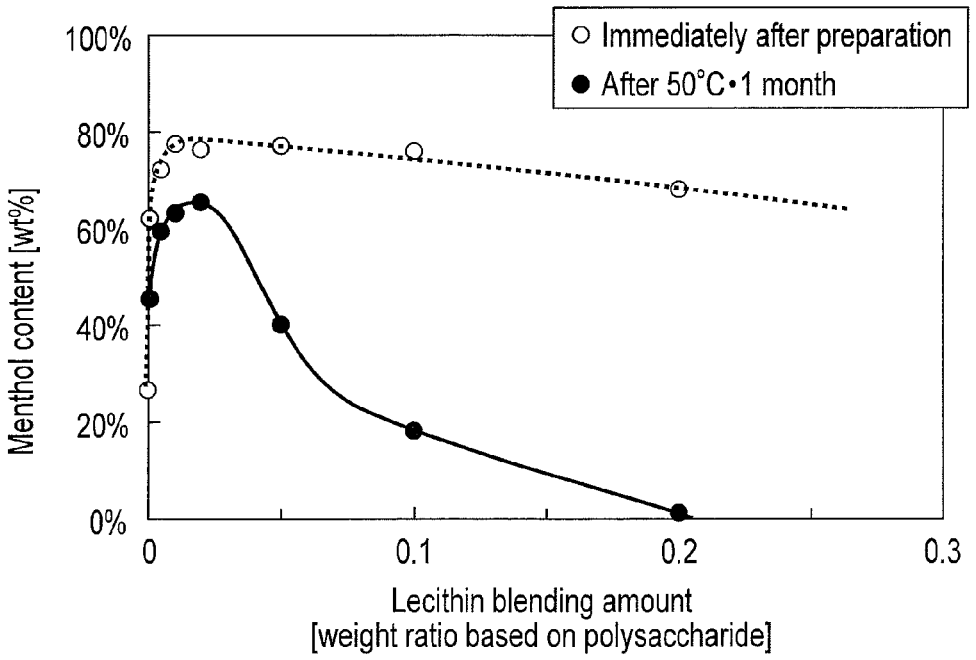
FIG. 10B is a graph showing a relationship between the blending amount of lecithin and the menthol content of the menthol-containing sheets (the case where the polysaccharide is carrageenan).
Figure 10C:
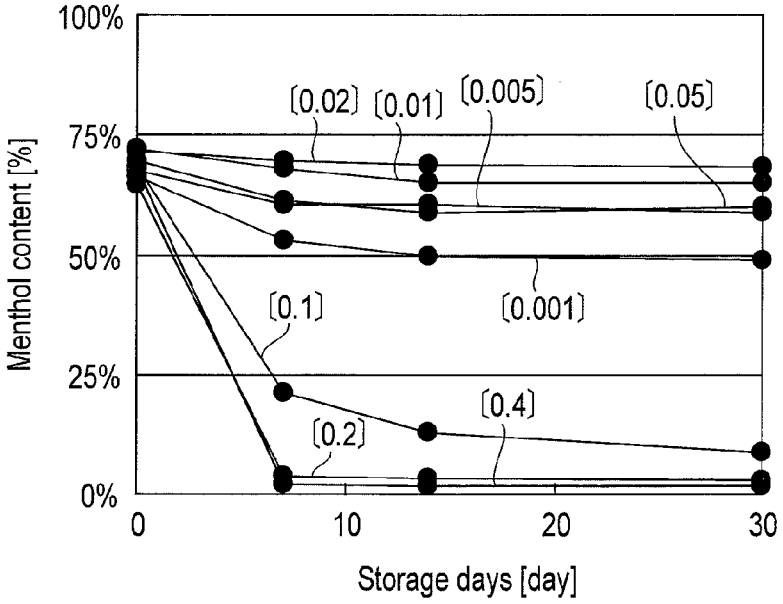
FIG. 10C is a graph showing the post-storage menthol content of menthol-containing sheets prepared using raw material slurries containing lecithin in various blending amounts (weight ratio based on the polysaccharide) (the case where the polysaccharide is gellan gum).
Figure 10D:
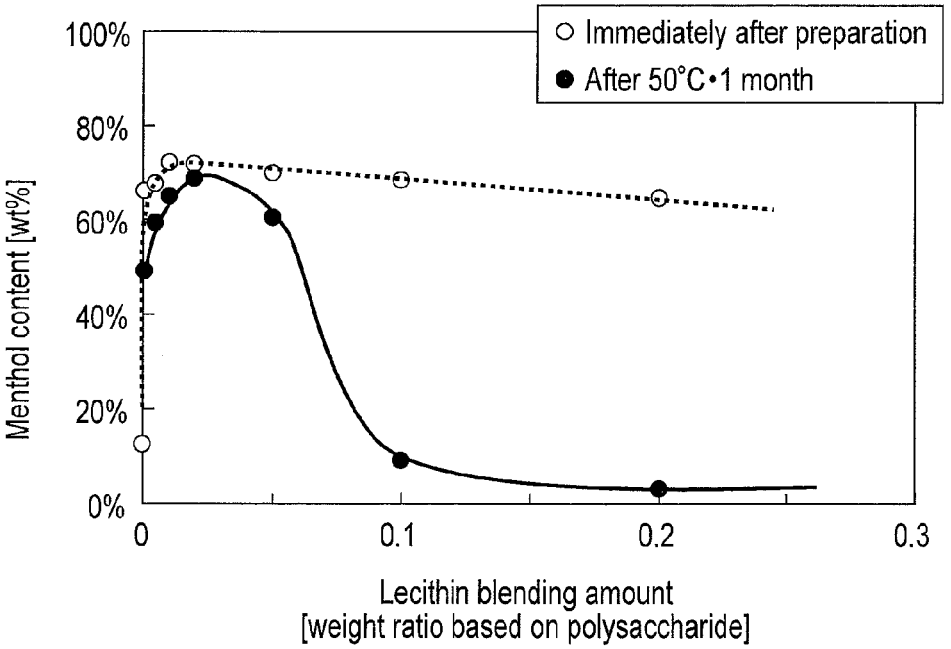
FIG. 10D is a graph showing a relationship between the blending amount of lecithin and the menthol content of the menthol-containing sheets (the case where the polysaccharide is gellan gum).

The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the carrageenan-containing sheet are shown in FIGS. 10A and 10B, and the results of the gellan gum-containing sheet are shown in FIGS. 10C and 10D. In FIGS. 10A and 10C, the numerical values in the parentheses represent weight ratios of lecithin based on polysaccharide. For example, the expression [0.01] represents that lecithin is contained in the raw material slurry in an amount equivalent to 0.01 times the weight of polysaccharide. In FIGS. 10B and 10D, the term "immediately after preparation" means a sheet immediately after the preparation, and the term "after 50° C.·1 month" means a sheet after storage at 50° C. for 30 days.

12-2. Results (1) Carrageenan-Containing Sheet

Regarding the carrageenan-containing sheets, as shown in FIG. 10A, the menthol content was largely reduced after storage in the case where the blending amount of lecithin to carrageenan was 0.1 to 0.4-fold weight.

FIG. 10B shows a relationship between the blending amount of lecithin (weight ratio based on carrageenan) and the menthol content (%). As shown in FIG. 10B, a high menthol content was maintained after storage in the sheets where the blending amount of lecithin to carrageenan was 0.005 to 0.02-fold weight.

(2) Gellan Gum-Containing Sheet

Regarding the gellan gum-containing sheets, as shown in FIG. 10C, the menthol content was largely reduced after storage in the case where the blending amount of lecithin to gellan gum was 0.1 to 0.4-fold weight.

FIG. 10D shows a relationship between the blending amount of lecithin (weight ratio based on gellan gum) and the menthol content (%). As shown in FIG. 10D, a high menthol content was maintained after storage in the sheets in which the blending amount of lecithin to gellan gum was 0.005 to 0.05-fold weight.

From the results of FIGS. 10A to 10D, it is found that the blending amount of lecithin to polysaccharide is preferably 0.5 to 5 wt %. Specifically, when carrageenan is used as the polysaccharide, the blending amount of lecithin to polysaccharide is preferably 0.5 to 2 wt %. When gellan gum is used as the polysaccharide, the blending amount of lecithin to polysaccharide is preferably 0.5 to 5 wt %, more preferably 0.5 to 2 wt %.

Example 13

In this example, an effect of the type of emulsifier on the post-storage menthol content of the menthol-containing sheets was examined.

13-1. Method (Preparation of Sheet and Measurement of Menthol Content)

Carrageenan-containing sheets and gellan gum-containing sheets were prepared using raw material slurries containing various types of emulsifiers. The sheet preparation was performed in accordance with the same procedure as Example 9. Menthol was added in an amount equivalent to 5 times the weight of polysaccharide, and each emulsifier was added in an amount equivalent to 0.02 times the weight of polysaccharide.

Eight types of emulsifiers below were used as the emulsifier. The numbers 1 to 8 given to the emulsifiers below correspond to the number of FIGS. 11A and 11B.

Figure 11A:
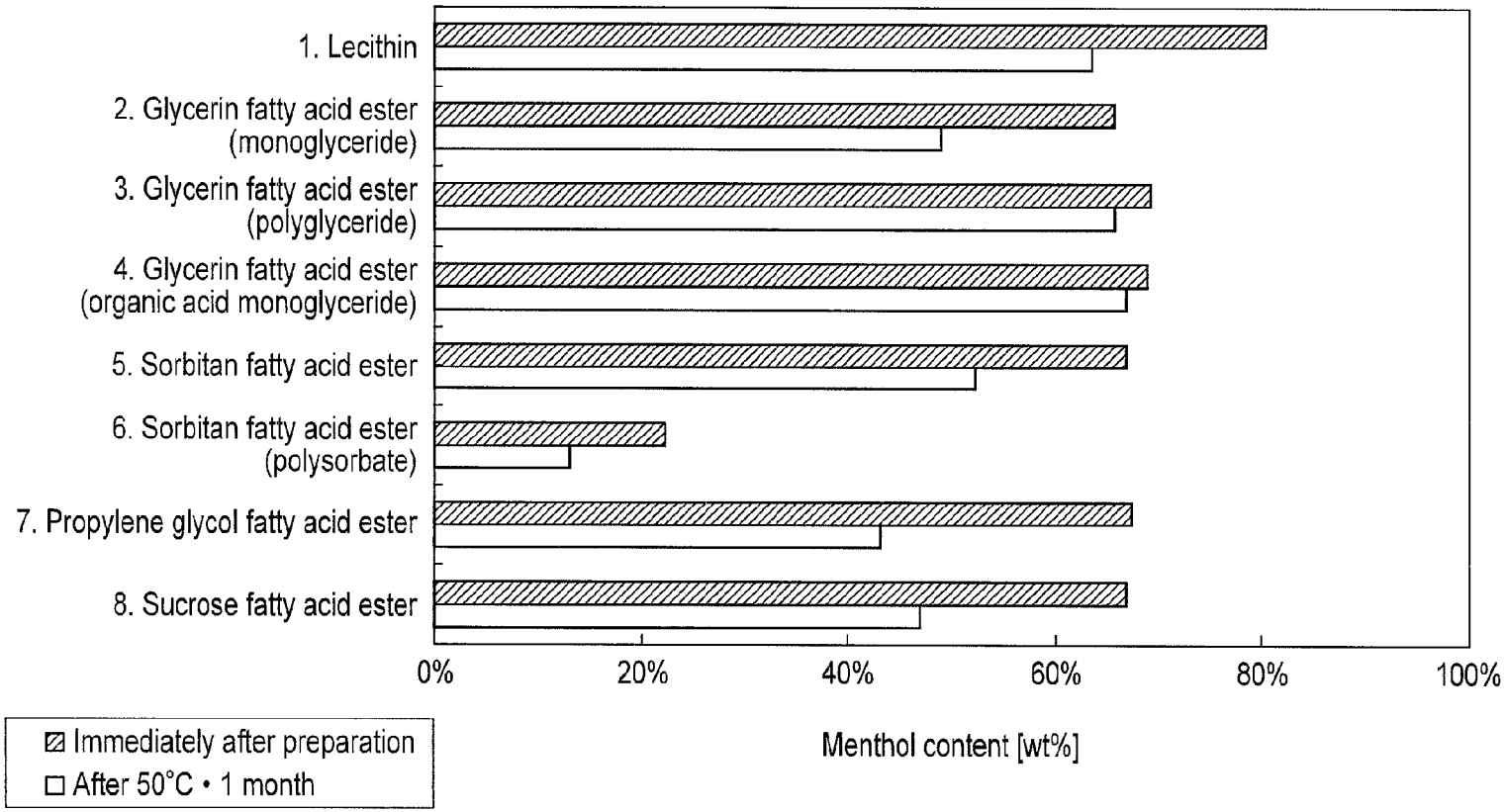
FIG. 11A is a graph showing effects of the type of emulsifier on the menthol content of the menthol-containing sheets (the case where the polysaccharide is carrageenan).
Figure 11B:
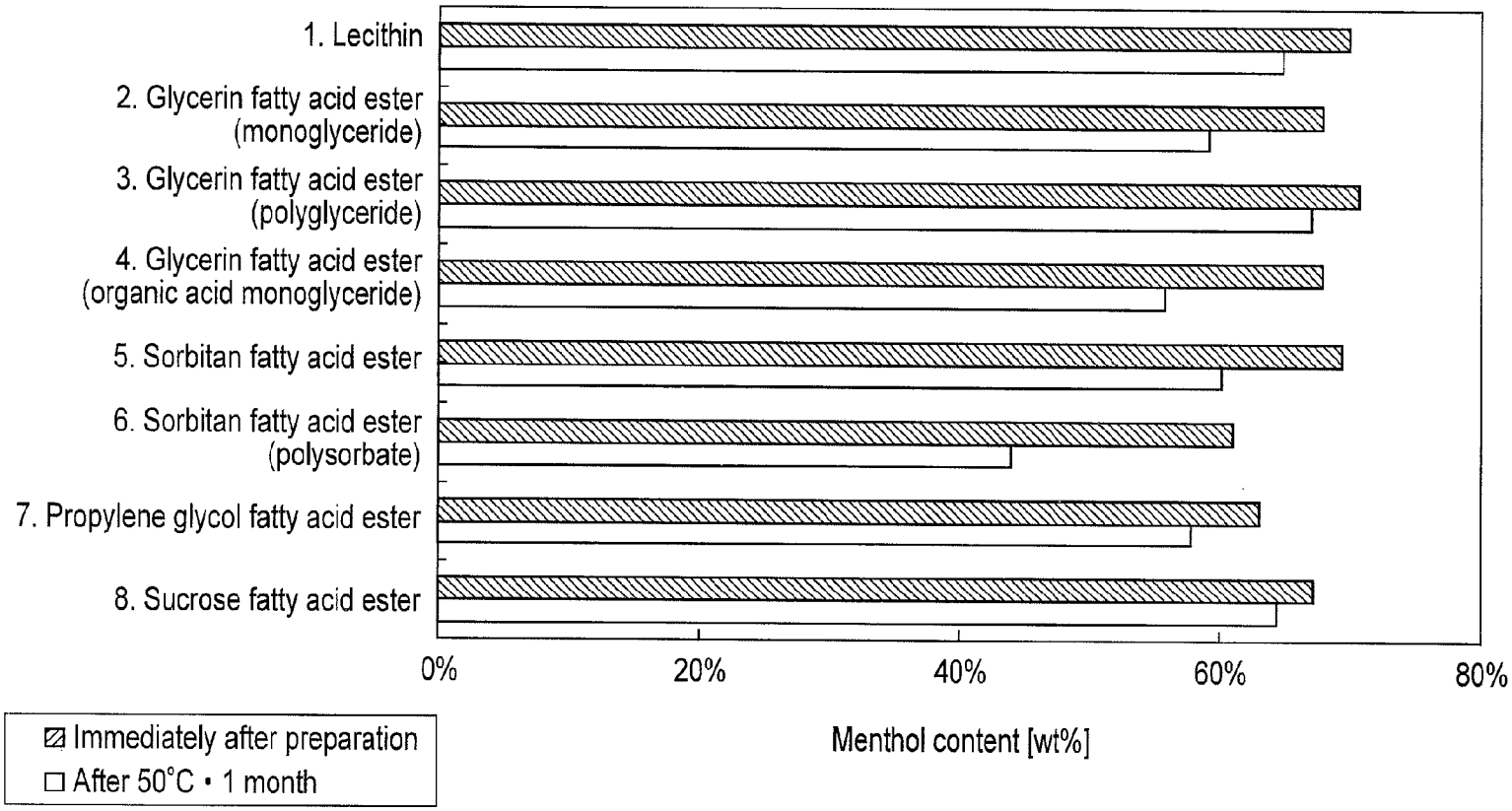
FIG. 11B is a graph showing effects of the type of emulsifier on the menthol content of the menthol-containing sheets (the case where the polysaccharide is gellan gum).

1. Lecithin
   (SUN LECITHIN A-1, manufactured by Taiyo Kagaku Co., Ltd.)
2. Glycerin Fatty Acid Ester (Monoglyceride)
   (Exel S-95, manufactured by Kao Corporation)
   Compound name: lipophilic glycerin monostearate
3. Glycerin Fatty Acid Ester (Polyglyceride)
   (Sunsoft A-181E, manufactured by Taiyo Kagaku Co., Ltd.)
   Compound name: pentaglycerin monostearate
4. Glycerin Fatty Acid Ester (Organic Acid Monoglyceride)
   (Step SS, manufactured by Kao Corporation)
   Compound name: monoglyceride succinate
5. Sorbitan Fatty Acid Ester
   (Emasol S-10V, manufactured by Kao Corporation)
   Compound name: sorbitan monostearate
6. Sorbitan Fatty Acid Ester (Polysorbate)
   (Emasol S-120V, manufactured by Kao Corporation)
   Compound name: polyoxyethylenesorbitan monostearate
7. Propylene Glycol Fatty Acid Ester
   (Sunsoft No. 25CD, manufactured by Taiyo Kagaku Co., Ltd.)
   Compound name: propylene glycol monostearate
8. Sucrose Fatty Acid Ester
   (Ryoto sugar ester S-1570, manufactured by Mitsubishi-Kagaku Foods Corporation)
   Compound name: sucrose stearic acid ester The menthol content of the sheet immediately after preparation (the initial menthol content) and the menthol content of the sheet stored in accelerated environments (the post-storage menthol content) were measured. The accelerated environments were as described in Example 1. The measurement of the menthol content was performed in accordance with the same procedure as Example 1. The results of the carrageenan-containing sheet are shown in FIG. 11A, and the results of the gellan gum-containing sheet are shown in FIG. 11B. In FIGS. 11A and 11B, the term "immediately after preparation" means a sheet immediately after the preparation, and the term "after 50° C.·1 month" means a sheet after storage at 50° C. for 30 days.

13-2. Results

The results of FIGS. 11A and 11B show that it is possible to use various emulsifiers in addition to lecithin. Regarding the carrageenan-containing sheets, it is particularly preferable to use 1. lecithin, 3. glycerin fatty acid ester (polyglyceride), and 4. glycerin fatty acid ester (organic acid monoglyceride) as emulsifiers. Regarding the gellan gum-containing sheets, it is particularly preferable to use 1. lecithin, 2. glycerin fatty acid ester (monoglyceride), 3. glycerin fatty acid ester (polyglyceride), 4. glycerin fatty acid ester (organic acid monoglyceride), 5. sorbitan fatty acid ester, 7. propylene glycol fatty acid ester, and 8. sucrose fatty acid ester as emulsifiers.

What is claimed is:

1. A method for preparing a flavor-containing sheet for a smoking article, comprising:

a step of extending a raw material slurry on a substrate, wherein the slurry contains polysaccharide including at least one of carrageenan and gellan gum, a flavor, an emulsifier and 70 to 95 wt % of water, has the flavor content of 100 to 1000 wt % based on the polysaccharide, and has a temperature of 60 to 90° C. in a sol state;

a step of cooling the extended raw material slurry to a sample temperature of 0 to 40° C. to form a gel; and a heat-drying step comprising heating the gelled raw material and drying it at a sample temperature of 70 to 100° C.

2. The method for preparing a flavor-containing sheet for a smoking article according to claim 1, wherein the emulsifier is 0.5 to 5 wt % of lecithin based on the polysaccharide.

3. The method for preparing a flavor-containing sheet for a smoking article according to claim 1, wherein the emulsifier is an ester selected from the group consisting of glycerin fatty acid ester, polyglycerin fatty acid ester, sorbitan fatty acid ester, propylene glycol fatty acid ester and sucrose fatty acid ester.

4. The method for preparing a flavor-containing sheet for a smoking article according to claim 1, wherein the polysaccharide is contained in the raw material slurry at a concentration of 2 to 6 wt %.

5. The method for preparing a flavor-containing sheet for a smoking article according to claim 1, wherein the flavor is menthol.

6. The method for preparing a flavor-containing sheet for a smoking article according to claim 5, wherein the menthol content is in a range of 250 to 500 wt % based on the polysaccharide.

7. The method for preparing a flavor-containing sheet for a smoking article according to claim 5, wherein the menthol content of the sheet after preparation is 45 wt % or more, and the menthol content of the sheet after storage at 50° C. for 30 days is 45 wt % or more.

8. The method for preparing a flavor-containing sheet for a smoking article according to claim 1, wherein the flavor content of the sheet after preparation is 45 wt % or more, and the flavor content of the sheet after storage at 50° C. for 30 days is 45 wt % or more.

9. The method for preparing a flavor-containing sheet for a smoking article according to claim 1, wherein the heat-drying step is performed for a total heat-drying time of 20 minutes or less.

* * * * *